US011386838B2

(12) United States Patent
Gao

(10) Patent No.: US 11,386,838 B2
(45) Date of Patent: Jul. 12, 2022

(54) PIXEL CIRCUIT AND METHOD OF DRIVING THE SAME, DISPLAY PANEL

(71) Applicant: BOE TECHNOLOGY GROUP CO., LTD., Beijing (CN)

(72) Inventor: Xueling Gao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 65 days.

(21) Appl. No.: 16/342,035

(22) PCT Filed: Sep. 29, 2018

(86) PCT No.: PCT/CN2018/108759

§ 371 (c)(1),
(2) Date: Apr. 15, 2019

(87) PCT Pub. No.: WO2019/137045

PCT Pub. Date: Jul. 18, 2019

(65) Prior Publication Data

US 2021/0366386 A1 Nov. 25, 2021

(30) Foreign Application Priority Data

Jan. 10, 2018 (CN) ..... 201810023293.3

(51) Int. Cl.
*G09G 3/3233* (2016.01)

(52) U.S. Cl.
CPC ... *G09G 3/3233* (2013.01); *G09G 2300/0426* (2013.01); *G09G 2300/0852* (2013.01);
(Continued)

(58) Field of Classification Search
CPC ..... G09G 3/3233; G09G 2300/0426; G09G 2300/0852; G09G 2300/0866; G09G 2310/061; G09G 2310/08
See application file for complete search history.

(56) References Cited

U.S. PATENT DOCUMENTS 8,237,634 B2 8/2012 Kwak
2012/0147060 A1 6/2012 Jeong
(Continued)

FOREIGN PATENT DOCUMENTS

CN 102568374 A 7/2012
CN 105590955 A 5/2016
(Continued)

OTHER PUBLICATIONS

International Search Report of PCT/CN2018/108759 in Chinese, dated Dec. 7, 2018, with English translation.
(Continued)

*Primary Examiner* — Robert J Michaud
(74) *Attorney, Agent, or Firm* — Collard & Roe, P.C.

(57) ABSTRACT

A pixel circuit and a method of driving the same, and a display panel. The pixel circuit includes a drive circuit, a data writing circuit, a compensating circuit, a reset circuit and a first light emitting control circuit. The drive circuit is configured to control a drive current for driving a light emitting element to emit light; the data writing circuit is configured to write a data signal to the first terminal of the drive circuit; the compensating circuit is configured to compensate the drive circuit; the reset circuit is configured to apply a reset voltage to the control terminal of the drive circuit and the first terminal of the light emitting element; the first light emitting control circuit is configured to apply a first voltage of the first voltage terminal to the first terminal of the drive circuit.

19 Claims, 11 Drawing Sheets

(52) U.S. Cl.
CPC ..... *G09G 2300/0866* (2013.01); *G09G 2310/061* (2013.01); *G09G 2310/08* (2013.01)

(56) References Cited

U.S. PATENT DOCUMENTS

| | | | | |
|---|---|---|---|---|
| 2015/0130859 | A1 | 5/2015 | Yang | |
| 2016/0133191 | A1 | 5/2016 | Kang et al. | |
| 2018/0158409 | A1* | 6/2018 | Byun | G09G 3/3275 |
| 2019/0096322 | A1 | 3/2019 | Gao | |

FOREIGN PATENT DOCUMENTS

| | | | |
|---|---|---|---|
| CN | 107358918 | A | 11/2017 |
| CN | 107452331 | A | 12/2017 |
| CN | 107452334 | A | 12/2017 |
| CN | 107767819 | A | 3/2018 |
| JP | 2010026488 | A | 2/2010 |
| WO | 2017/172375 | A1 | 10/2017 |

OTHER PUBLICATIONS

Notice of Transmittal of the International Search Report of PCT/CN2018/108759 in Chinese, dated Dec. 7, 2018.
Written Opinion of the International Searching Authority of PCT/CN2018/108759 in Chinese, dated Dec. 7, 2018 with English translation.
Japanese Office Action in Japanese Application No. 2019-547359 dated May 16, 2022 with English translation.

* cited by examiner

PIXEL CIRCUIT AND METHOD OF DRIVING THE SAME, DISPLAY PANEL

This application is the National Stage of PCT/CN2018/108759 filed on Sep. 29, 2018, which claims priority under 35 U.S.C. § 119 of Chinese Application No. 201810023293.3 filed on Jan. 10, 2018, the disclosure of which is incorporated by reference.

TECHNICAL FIELD

The embodiments of the present disclosure relate to a pixel circuit and a method of driving the same, and a display panel.

BACKGROUND

Due to its advantages of a wide viewing angle, high contrast, a fast response speed as well as a higher luminance and a lower drive voltage than an inorganic light emitting display device, an organic light emitting diode (OLED) display device is attracting more and more attention. Due to the above-mentioned characteristics, the OLED may be applied to devices with a display function, such as a mobile phone, a display, a laptop, a digital camera, a navigator or the like.

SUMMARY

At least one embodiment of the present disclosure provides a pixel circuit, which comprises a drive circuit, a data writing circuit, a compensating circuit, a reset circuit and a first light emitting control circuit; wherein the drive circuit comprises a control terminal, a first terminal and a second terminal, and the drive circuit is configured to control a drive current for driving a light emitting element to emit light;

the data writing circuit is coupled to the first terminal of the drive circuit, and the data writing circuit is configured to write a data signal to the first terminal of the drive circuit in response to a scan signal;

the compensating circuit is coupled to the control terminal and the second terminal of the drive circuit and a first voltage terminal, and the compensating circuit is configured to compensate the drive circuit in response to the scan signal and the written data signal;

the reset circuit is coupled to the control terminal of the drive circuit and the light emitting element, and the reset circuit is configured to apply a reset voltage to the control terminal of the drive circuit and the first terminal of the light emitting element in response to a reset signal; and the first light emitting control circuit is coupled to the first terminal of the drive circuit, and the first light emitting control circuit is configured to apply a first voltage of the first voltage terminal to the first terminal of the drive circuit in response to a first light emitting control signal.

For example, the pixel circuit according to at least an embodiment of the present disclosure further comprises a second light emitting control circuit, wherein a first terminal and a second terminal of the second light emitting control circuit are coupled to a first terminal of the light emitting element and the second terminal of the drive circuit respectively, and the first terminal and the second terminal of the second light emitting control circuit are configured to apply the drive current to the light emitting element in response to a second light emitting control signal.

For example, the pixel circuit according to at least an embodiment of the present disclosure further comprises a light emitting control signal switch circuit, wherein the light emitting control signal switch circuit is coupled to a control terminal of the first light emitting control circuit and a control terminal of the second light emitting control circuit, and the light emitting control signal switch circuit is configured to apply the first light emitting control signal and the second light emitting control signal to the control terminal of the first light emitting control circuit and the control terminal of the second light emitting control circuit alternately in response to the light emitting control switch signal.

For example, in the pixel circuit according to at least an embodiment of the present disclosure, the drive circuit comprises a first transistor;

a gate of the first transistor is used as the control terminal of the drive circuit, a first electrode of the first transistor is used as the first terminal of the drive circuit, and a second electrode of the first transistor is used as the second terminal of the drive circuit.

For example, in the pixel circuit according to at least an embodiment of the present disclosure, the data writing circuit comprises a second transistor;

a gate of the second transistor is used as a control terminal of the data writing circuit and is configured to be coupled to a scan line to receive the scan signal, a first electrode of the second transistor is used as a first terminal of the data writing circuit and is configured to be coupled to a data line to receive the data signal, and a second electrode of the second transistor is used as a second terminal of the data writing circuit and is coupled to the first terminal of the drive circuit.

For example, in the pixel circuit according to at least an embodiment of the present disclosure, the compensating circuit comprises a third transistor and a capacitor;

a gate of the third transistor is coupled to a scan line to receive the scan signal, a first electrode of the third transistor is coupled to the control terminal of the drive circuit, a second electrode of the third transistor is coupled to the second terminal of the drive circuit; and a first electrode of the capacitor is coupled to the control terminal of the drive circuit, a second electrode of the capacitor is coupled to the first voltage terminal to receive a first voltage.

For example, in the pixel circuit according to at least an embodiment of the present disclosure, the reset circuit comprises a fourth transistor and a fifth transistor;

a gate of the fourth transistor is coupled to a reset control line to receive the reset signal, a first electrode of the fourth transistor is coupled to the control terminal of the drive circuit, and a second electrode of the fourth transistor is coupled to a reset voltage terminal to receive the reset voltage; and a gate of the fifth transistor is coupled to the reset control line to receive the reset signal, a first electrode of the fifth transistor is coupled to the first terminal of the light emitting element, and a second electrode of the fifth transistor is coupled to the reset voltage terminal to receive the reset voltage.

For example, in the pixel circuit according to at least an embodiment of the present disclosure, the first light emitting control circuit comprises a sixth transistor;

a gate of the sixth transistor is used as a control terminal of the first light emitting control circuit and is configured to be coupled to a first light emitting control line to receive the first light emitting control signal, a first electrode of the sixth transistor is used as a first terminal of the first light emitting control circuit, and is configured to be coupled to the first voltage terminal to receive the first voltage, and a second electrode of the sixth transistor is used as a second terminal of the first light emitting control circuit and is coupled to the first terminal of the drive circuit.

For example, in the pixel circuit according to at least an embodiment of the present disclosure, the second light emitting control circuit comprises a seventh transistor;

a gate of the seventh transistor is used as a control terminal of the second light emitting control circuit, and is coupled to a second light emitting control line to receive the second light emitting control signal, a first electrode of the seventh transistor is used as the second terminal of the second light emitting control circuit and is coupled to the second terminal of the drive circuit, and a second electrode of the seventh transistor is used as the first terminal of the second light emitting control circuit and is coupled to the first terminal of the light emitting element.

For example, in the pixel circuit according to at least an embodiment of the present disclosure, the first light emitting control signal and the second light emitting control signal are both turn-on signals at least in part of a period.

For example, in the pixel circuit according to at least an embodiment of the present disclosure, the light emitting control signal switch circuit comprises an eighth transistor, a ninth transistor, a tenth transistor and an eleventh transistor;

a gate of the eighth transistor is configured to receive the light emitting control switch signal, a first electrode of the eighth transistor is coupled to a first light emitting control line to receive the first light emitting control signal, a second electrode of the eighth transistor is coupled to the control terminal of the first light emitting control circuit;

a gate of the ninth transistor is configured to receive the light emitting control switch signal, a first electrode of the ninth transistor is coupled to a second light emitting control line to receive the second light emitting control signal, a second electrode of the ninth transistor is coupled to the control terminal of the second light emitting control circuit;

a gate of the tenth transistor is configured to receive the light emitting control switch signal, a first electrode of the tenth transistor is coupled to the second light emitting control line, a second electrode of the tenth transistor is coupled to the control terminal of the first light emitting control circuit; and a gate of the eleventh transistor is configured to receive the light emitting control switch signal, a first electrode of the eleventh transistor is coupled to the first light emitting control line, a second electrode of the eleventh transistor is coupled to the control terminal of the second light emitting control circuit.

At least one embodiment of the present disclosure provides a display panel, which comprises a plurality of pixel units arranged in an array, wherein each of the plurality of pixel units comprises the pixel circuit according to the embodiments of the present disclosure and a light emitting element.

For example, in the display panel according to at least an embodiment of the present disclosure, the pixel circuit further comprises a light emitting control signal switch circuit, the first light emitting control circuit and a second light emitting control circuit, the light emitting control signal switch circuit is electrically coupled to a first light emitting control line, a second light emitting control line, a control terminal of the first light emitting control circuit and a control terminal of the second light emitting control circuit, and the light emitting control signal switch circuit is configured to apply the first light emitting control signal provided by the first light emitting control line and a second light emitting control signal provided by the second light emitting control line to the control terminal of the first light emitting control circuit and the control terminal of the second light emitting control circuit alternately in response to a light emitting control switch signal;

the display panel further comprises a plurality of light emitting control switch signal lines, wherein the plurality of pixel units is arranged in a plurality of rows, control terminals of the light emitting control signal switch circuits of the pixel circuits of a m-th row of pixel units are coupled to a same light emitting control switch signal line, or the control terminals of the light emitting control signal switch circuits of the pixel circuits of the m-th row of pixel units are coupled to two light emitting control switch signal lines, wherein a rising edge of a light emitting control switch signal provided by one of the two light emitting control switch signal lines corresponds to a falling edge of a light emitting control switch signal provided by a remaining one of the two light emitting control switch signal lines, wherein m is an integer greater than or equal to 1.

For example, in the display panel according to at least an embodiment of the present disclosure, a first terminal of the light emitting element is configured to receive the drive current from the second terminal of the drive circuit, and a second terminal of the light emitting element is configured to be coupled to a second voltage terminal.

At least one embodiment of the present disclosure provides a method of driving the pixel circuit according to claim 1, comprising: an initialization stage, a data writing and compensating stage and a light emitting stage; wherein at the initialization stage, inputting the reset signal to turn on the reset circuit to apply the reset voltage to the control terminal of the drive circuit and the first terminal of the light emitting element;

at the data writing and compensating stage, inputting the scan signal and the data signal to turn on the data writing circuit, the drive circuit and the compensating circuit so that the data writing circuit writes the data signal to the drive circuit, and the compensating circuit compensates the drive circuit; and at the light emitting stage, inputting the first light emitting control signal to turn on the first light emitting control circuit and the drive circuit so that the first light emitting control circuit applies the drive current to the light emitting element to make the light emitting element emit light.

At least one embodiment of the present disclosure provides a method of driving the pixel circuit according to claim 2, comprising: an initialization stage, a data writing and compensating stage, a pre-light emitting stage and a light emitting stage; wherein at the initialization stage, inputting the reset signal and the second light emitting control signal to turn on the reset circuit and the second light emitting control circuit to apply the reset voltage to the control terminal and the second terminal of the drive circuit and the first terminal of the light emitting element;

at the data writing and compensating stage, inputting the scan signal and the data signal to turn on the data writing circuit, the drive circuit and the compensating circuit so that the data writing circuit writes the data signal to the drive circuit, and the compensating circuit compensates the drive circuit;

at the pre-light emitting stage, inputting the first light emitting control signal to turn on the first light emitting control circuit and the drive circuit so that the first light emitting control circuit applies the first voltage to the first terminal of the drive circuit; and at the light emitting stage, inputting the first light emitting control signal and the second light emitting control signal to turn on the first light emitting control circuit, the second light emitting control circuit and the drive circuit so that the second light emitting control circuit applies the drive current to the light emitting element to make the light emitting element emit light.

At least one embodiment of the present disclosure provides a method of driving the pixel circuit according to claim 3, comprising: an initialization stage, a data writing and compensating stage, a pre-light emitting stage and a light emitting stage; wherein at the initialization stage, inputting the reset signal, the second light emitting control signal and the light emitting control switch signal to turn on the reset circuit and the light emitting control signal switch circuit to apply the second light emitting control signal to the control terminal of the first light emitting control circuit or the control terminal of the second light emitting control circuit and apply the reset voltage to the control terminal of the drive circuit and the first terminal of the light emitting element;

at the data writing and compensating stage, inputting the scan signal and the data signal to turn on the data writing circuit, the drive circuit and the compensating circuit so that the data writing circuit writes the data signal to the drive circuit, and the compensating circuit compensates the drive circuit;

at the pre-light emitting stage, inputting the light emitting control switch signal and the first light emitting control signal to apply the first light emitting control signal to the control terminal of the first light emitting control circuit or the control terminal of the second light emitting control circuit, wherein in a case where the first light emitting control signal is applied to the control terminal of the first light emitting control circuit, the first light emitting control circuit applies the first voltage to the first terminal of the drive circuit; and at the light emitting stage, inputting the light emitting control switch signal, the first light emitting control signal and the second light emitting control signal to turn on the first light emitting control circuit, the second light emitting control circuit and the drive circuit so that the second light emitting control circuit applies the drive current to the light emitting element to make the light emitting element emit light.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1A:
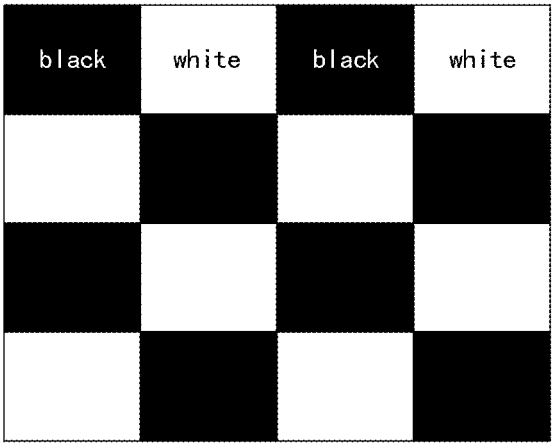
FIG. 1A is a schematic diagram of a first image displayed by a display device.

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In addition, the term "turn-on signal" used herein refers to a signal of a level that is capable of turning on transistors or circuits including transistors. For example, a signal of a low level is the turn-on signal for a P-type transistor; a signal of a high level is the turn-on signal for an N-type transistor.

The embodiments of the present disclosure are described in detail below, and the examples of the embodiments are illustrated in the drawings, wherein the same or similar reference numerals are used to refer to the same or similar elements or elements having the same or similar functions. The embodiments described below with reference to the accompanying drawings are intended to be illustrative, and are not to be construed as limiting.

The pixel circuit in an OLED display device usually adopts a matrix-driven manner, and the matrix-driven manner is divided into an AM (active matrix)-driven manner and a PM (passive matrix)-driven manner according to whether there is a switch device introduced in each pixel unit. In spite of its simple process and low costs, a PMOLED cannot meet requirements of high resolution and large-size display due to its disadvantages of cross talk, high power consumption, a short service life, or the like. By contrast, in the AMOLED, generally, a group of thin film transistors and storage capacitors is integrated in the pixel circuit of each pixel. With the drive control over the thin film transistor and the storage capacitor, the control over the current flowing through the OLED is implemented, thereby making the OLED emit light as required. Compared with the PMOLED, the AMOLED needs a small drive current and has low power consumption and a longer service life, so may meet the display requirements of high resolution, multiple gray levels and large size. Also, the AMOLED has distinct advantages in terms of viewing angle, color rendition, power consumption and response time, and is suitable for a display device with rich information and a high resolution.

In an AMOLED display device, a 2T1C pixel circuit is usually used as a basic pixel circuit, i.e., two TFTs (Thin-Film Transistor) and one storage capacitor Cs are used to implement the basic function of driving an OLED to emit light.

Usually, the OLED display device includes a plurality of pixel units arranged in an array, and each pixel may include the above-mentioned pixel circuit. In the OLED display device, there may be a difference in the threshold voltages of drive transistors of individual pixel circuits due to the manufacture process. Moreover, due to the change of temperature, the threshold voltage of the drive transistor may drift. Therefore, different threshold voltages of the drive transistors may cause a poor display effect (for example, a non-uniform display effect), so the threshold voltage ought to be compensated. When the drive transistor is in an OFF state, due to a leakage current, a poor display effect may also be caused. In addition, other pixel circuits with a compensation function are provided in the industry based on the above-mentioned basic 2T1C pixel circuit. The compensation function may be implemented by voltage compensation, current compensation or combined compensation. The pixel circuit with the compensation function may be for example a 4T1C pixel circuit, a 4T2C pixel circuit, a 7T1C pixel circuit, or the like, which will not be described in detail herein.

Due to a retardation effect of the drive transistor in the pixel circuit of the display device, when the display device switches to the next image after the display device displays the same image for some time, the residual of part of the former displayed image may appear in the next image, and the residual would disappear after a period of time, which is referred to as a phenomenon of short-term residual image. The retardation effect is mainly caused by the threshold voltage (Vth) drift due to residual movable carriers in the drive transistor. In the case where different pictures are switched, $V_{GS}$ (a voltage between a gate and a source of the drive transistor) at their initialization stages may be different, which may cause different levels of threshold voltage drift of the drive transistor, thereby leading to the short-term residual image.

Figure 1B:
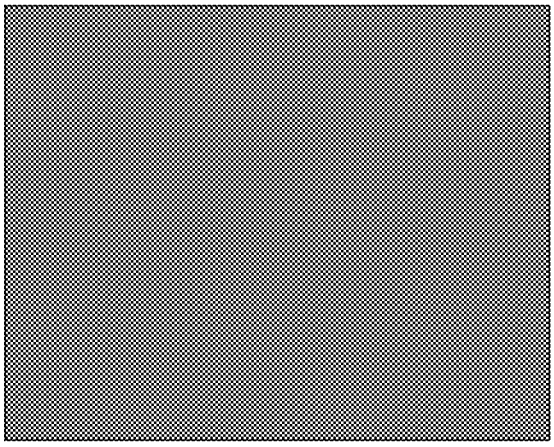
FIG. 1B is a schematic diagram of a second image to be displayed by the above-mentioned display device.
Figure 1C:
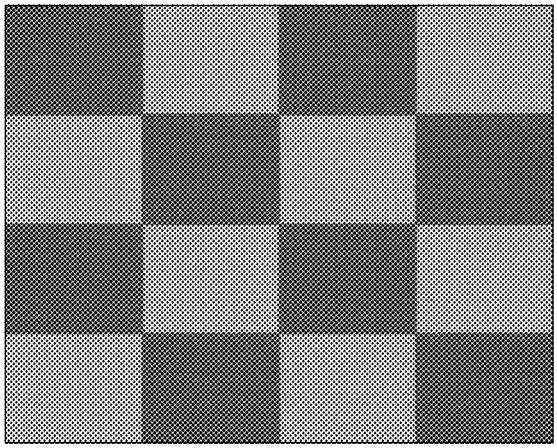
FIG. 1C is a schematic diagram of the second image actually displayed by the above-mentioned display device.

For example, FIG. 1A is a schematic diagram of a first image displayed by a display device, FIG. 1B is a schematic diagram of a second image to be displayed by the display device; and FIG. 1C is a schematic diagram of the second image actually displayed by the display device. After the display device displays a first image such as a black-and-white chessboard as shown in FIG. 1A, for some time, and the display device switches to a second image (for example, the image with a gray level of 48 as shown in FIG. 1B), there is still a residual of part of the first image (black and white chessboard) shown in FIG. 1A, as shown in FIG. 1C.

At least one embodiment of the present disclosure provides a pixel circuit. This pixel circuit includes a drive circuit, a data writing circuit, a compensating circuit, a reset circuit and a first light emitting control circuit. The drive circuit includes a control terminal, a first terminal and a second terminal, and is configured to control a drive current for driving a light emitting element to emit light; the data writing circuit is coupled to the first terminal of the drive circuit, and is configured to write a data signal to the first terminal of the drive circuit in response to a scan signal; the compensating circuit is coupled to the control terminal and the second terminal of the drive circuit and a first voltage terminal, and is configured to compensate the drive circuit in response to the scan signal and the written data signal; the reset circuit is coupled to the control terminal of the drive circuit and the light emitting element, and is configured to apply a reset voltage to the control terminal of the drive circuit and the first terminal of the light emitting element in response to the reset signal; the first light emitting control circuit is coupled to the first terminal of the drive circuit, and is configured to apply the first voltage of the first voltage terminal to the first terminal of the drive circuit in response to the first light emitting control signal.

At least one embodiment of the present disclosure further provides a driving method of the above-mentioned pixel circuit, and a display panel.

The pixel circuit and the driving method thereof and the display panel according to the above-mentioned embodiments of the present disclosure, on the one hand, may make the drive transistor be in an off-bias or on-bias state with $V_{GS}$ being constantly biased at an initialization stage, thereby alleviating the problem of the short-term residual image which may occur due to the retardation effect; on the other hand, the pixel circuit and the driving method thereof and the display panel according to the above-mentioned embodiments of the present disclosure may compensate the threshold voltage of the drive circuit of the pixel circuit, so as to avoid a non-uniform display effect of the display device, thereby improving the display effects of the display device which adopts this pixel circuit.

The embodiments of the present disclosure and the examples thereof will be described below in detail in combination with the accompanying drawings.

An example of the embodiment of the present disclosure provides a pixel circuit 10, which, for example, is used for driving a light emitting element 600 in a subpixel of the display device to emit light. In at least one embodiment of the present disclosure, the display panel of the display device is prepared by for example, a glass substrate. The specific structure and the preparation process may adopt conventional means in the art, which will not be described in detail herein, and the embodiments of the present disclosure have no limitation in this respect.

Figure 2:
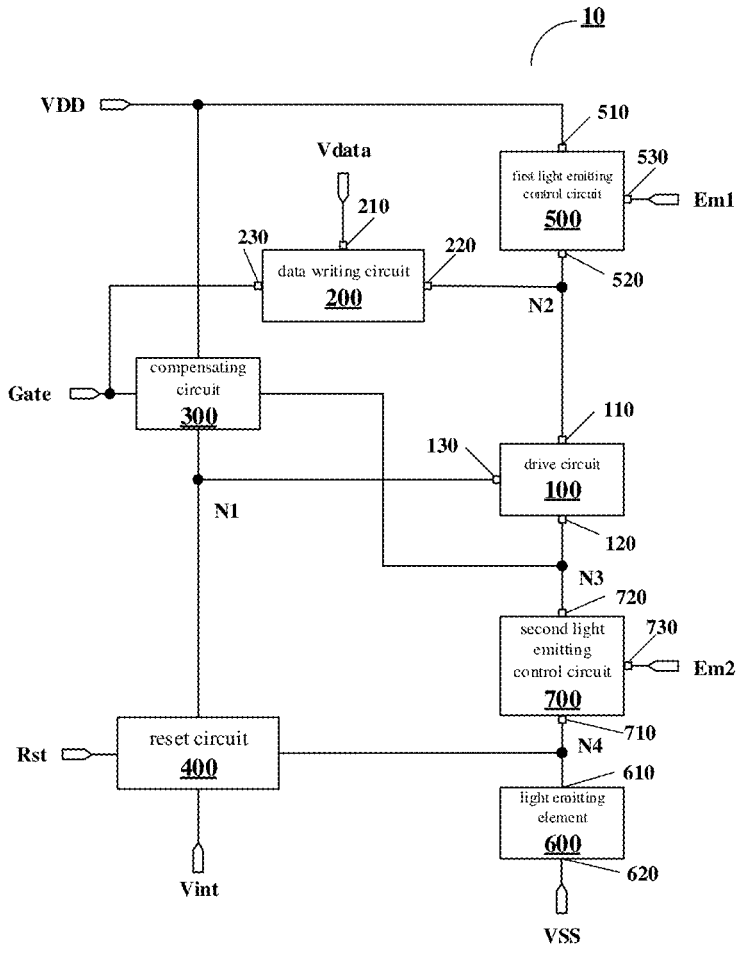
FIG. 2 is a schematic block diagram of a pixel circuit according to at least an embodiment of the present disclosure.

As shown in FIG. 2, this pixel circuit 10 includes a drive circuit 100, a data writing circuit 200, a compensating circuit 300, a reset circuit 400 and a first light emitting control circuit 500.

For example, the drive circuit 100 includes a first terminal 110, a second terminal 120 and a control terminal 130, and the drive circuit 100 is configured to control the drive current for driving the light emitting element 600 to emit light. The control terminal 130 of the drive circuit 100 is coupled to a first node N1, the first terminal 110 of the drive circuit 100 is coupled to a second node N2, and the second terminal 120 of the drive circuit 100 is coupled to a third node N3. For example, at the light emitting stage, the drive circuit 100 may provide the drive current for the light emitting element 600, to drive the light emitting element 600 to emit light according to the required "gray level". For example, as the light emitting element 600, an OLED or QLED (Quantum Dot Light Emitting Diode), or the like may be used, and the light emitting element 600 is configured to be coupled to the third node N3 and the second voltage terminal VSS (for example, a low voltage terminal), and the embodiment of the present disclosure includes, but is not limited to this situation. Correspondingly, the display panel is an OLED panel or a QLED panel. The following description will be made by taking the OLED as an example below, and corresponding descriptions are also applicable to the OLED.

For example, the data writing circuit 200 is coupled to the first terminal 110 (second node N2) of the drive circuit 100, and is configured to write the data signal to the first terminal 110 of the drive circuit 100 in response to the scan signal. For example, the data writing circuit 200 includes a first terminal 210, a second terminal 220 and a control terminal 230, and is coupled to a data line (data signal terminal Vdata), the second node N2 and the scan line (scan signal terminal Gate). For example, the scan signal from the scan signal terminal Gate is applied to the control terminal 230 of the data writing circuit 200, to control the data writing circuit 200 to be turned on or off.

For example, at a data writing stage, the data writing circuit 200 may be turned on in response to the scan signal, thereby writing the data signal to the first terminal 110 (second node N2) of the drive circuit 100, and storing the data signal in the compensating circuit 300, such that at a light emitting period, the drive current for driving the light emitting element 600 to emit light may be generated according to this data signal. For example, the magnitude of the data voltage Vdata determines a luminance (that is, the gray level for displaying) of this pixel unit.

For example, the compensating circuit 300 is coupled to the control terminal 130 (first node N1) and the second terminal 120 (third node N3) of the drive circuit and the first voltage terminal VDD (for example, high voltage terminal), and is configured to compensate the drive circuit 100 in response to the scan signal and the written data signal. For example, the compensating circuit 300 may be coupled to the scan signal terminal Gate, the first voltage terminal VDD, the first node N1 and the third node N3. For example, the scan signal from the scan signal terminal Gate is applied to the compensating circuit 300 to control the compensation circuit 300 to be turned on and off. For example, in a case where the compensating circuit 300 includes a capacitor, the compensating circuit 300 may be turned on, for example, at the data writing and compensating stage, in response to the scan signal, thereby storing the data signal written by the data writing circuit 200 in this capacitor. For example, at both the data writing stage and the compensating stage, the compensating circuit 300 may connect the control terminal 130 and the second terminal 120 of the drive circuit 100 electrically, such that the related information of the threshold voltage of the drive circuit 100 is also stored in this capacitor correspondingly, thereby controlling the drive circuit 100 by using the stored data signal and the threshold voltage signal at the light emitting stage, and compensating the output of the drive circuit 100.

For example, the light emitting element 600 includes a first terminal 610 and a second terminal 620. The first terminal 610 of the light emitting element 600 is configured to receive the drive current from the second terminal 120 of the drive circuit, and the second terminal 620 of the light emitting element 600 is configured to be coupled to the second voltage terminal VSS. For example, as shown in FIG. 2, when this pixel circuit 10 includes a second light emitting control circuit, the first terminal 610 of the light emitting element 600 is coupled to a fourth node N4.

For example, the reset circuit 400 is coupled to the control terminal 130 (first node N1) of the drive circuit 100 and the first terminal 610 of the light emitting element 600, and is configured to apply the reset voltage Vint to the control terminal 130 of the drive circuit and to the first terminal 610 of the light emitting element 600 in response to the reset signal. For example, as shown in FIG. 2, this reset circuit 400 is coupled to the first node N1, the reset voltage terminal Vint, the first terminal 610 of the light emitting element 600 and the reset control terminal Rst (a reset control line) respectively. For example, at the initialization stage, the reset circuit 400 may be turned on in response to the reset signal, thereby applying the reset voltage to the first node N1 and the first terminal 610 of the light emitting element 600, thereby resetting the drive circuit 100, the compensating circuit 30 and the light emitting element 600, and eliminating the influence of the former light emitting stage.

For example, when the reset voltage Vint is applied to the gate of the drive transistor via the reset circuit 400, and the potential of the source of the drive transistor is discharged to Vint-Vth, thus at this stage, the voltage $V_{GS}$ between the gate and the source of the drive transistor satisfies: $|V_{GS}|<|Vth|$ (Vth is the threshold voltage of the drive transistor, for example, when the drive transistor is of a P type, Vth is usually negative, and when the drive transistor is of an N type, Vth is usually positive), such that the drive transistor is in an off-bias state with $V_{GS}$ being constantly biased. With this configuration, the drive transistor starts from the off-bias state with $V_{GS}$ being constantly biased and enters for example, the data writing stage and the compensating stage, regardless of whether the data signal of the former frame is in a black state or a white state, thereby alleviating the problem of a short-term residual image due to the retardation effect of the display device which adopts the traditional pixel circuit.

For example, the first light emitting control circuit 500 is coupled to the first terminal 110 (second node N2) of the drive circuit, and is configured to apply the first voltage of the first voltage terminal VDD to the first terminal 110 of the drive circuit 100 in response to the first light emitting control signal. For example, as shown in FIG. 2, the first light emitting control circuit 500 includes a control terminal 530, a first terminal 510 and a second terminal 520, which are coupled to the first light emitting control terminal EM1, the first voltage terminal VDD and the second node N2 respectively. For example, the first light emitting control terminal Em1 may be coupled to the first light emitting control line which provides the first light emitting control signal, or coupled to the control circuit which provides the first light emitting control signal. For example, at the light emitting stage, the first light emitting control circuit 500 may be turned on in response to the first light emitting control signal, thereby applying the first voltage VDD to the first terminal 110 of the drive circuit 100. When the drive circuit 100 is turned on, the drive circuit 100 applies the first voltage VDD to the light emitting element 600 to provide the drive voltage, thereby driving the light emitting element to emit light. For example, the first voltage VDD may be the drive voltage, for example a high voltage.

For example, as shown in FIG. 2, in another example of the present embodiment, the pixel circuit 10 may further include a second light emitting control circuit 700. The second light emitting control circuit 700 includes a control terminal 730, a first terminal 710 and a second terminal 720, which are coupled to the second light emitting control terminal Em2, the first terminal 610 of the second light emitting element 600 and the second terminal 120 of the drive circuit 100 respectively, and the second light emitting control circuit 700 is configured to apply the drive current to the light emitting element 600 in response to the second light emitting control signal.

For example, at the light emitting stage, the second light emitting control circuit 700 is turned on in response to the second light emitting control signal provided by the second light emitting control terminal Em2, such that the drive circuit 100 may apply the drive current to the light emitting element 600 through the second light emitting control circuit 700 to make the light emitting element 600 emit light; at the non-luminance stage, the second light emitting control circuit 700 is turned off in response to the second light emitting control signal, thereby preventing the current from flowing through the light emitting element 600 to make light emitting element 600 emit light, and improving the contrast of the corresponding display device.

For another example, at the initialization stage, the second light emitting control circuit 700 may also be turned on in response to the second light emitting control signal, thereby resetting the drive circuit 100 and the light emitting element 600 in combination with the reset circuit.

For example, the second light emitting control signal is different from the first light emitting control signal. For example, the second light emitting control signal and the first light emitting control signal may be coupled to different signal output terminals. As mentioned above, at the initialization, only the second light emitting control signal may be used as a turn-on signal. For example, the first light emitting control signal and the second light emitting control signal are both turn-on signals at least in part of a period. For example, at the light emitting stage, the first light emitting control signal and the second light emitting control signal are turn-on signals, such that the light emitting element 600 emits light. For example, a falling edge of the second light emitting control signal may also be synchronized with that of the first light emitting control signal, thereby entering the light emitting stage directly from the data writing and compensating stage.

It should be noted that the first light emitting control signal and the second light emitting control signal in the embodiment of the present disclosure have different timings. For example, in a display device, when the pixel circuits 10 are arranged in an array, for a row of pixel units, the first light emitting control signal may be a control signal for controlling the first light emitting control circuits 500 in the pixel circuits 10 of the row of pixel units. Also, this first light emitting control signal further controls the second light emitting control circuit 700 in the previous row of pixel circuits 10; similarly, the second light emitting control signal controls the second light emitting control circuit 700 in this row of pixel circuits 10, and this second light emitting control signal further controls the first light emitting control circuit 500 in the next row of pixel circuits 10.

For example, in the case where the drive circuit 100 is implemented as the drive circuit, for example, the gate of the drive transistor may be used as the control terminal 130 of the drive circuit 100 (coupled to the first node N1), the first electrode (for example, the source) may be used as the first terminal 110 of the drive circuit 100 (coupled to the second node N2), and the second electrode (for example, the drain) may be used as the second terminal 120 of the drive circuit 100 (coupled to the third node N3).

It should be noted that the first voltage terminal VDD in the embodiment of the present disclosure keeps being input with a DC high-level signal, the DC high level referred to as a first voltage; the second voltage terminal VSS keeps being input with a DC low-level signal, the DC low level referred to as a second voltage. For example, the second voltage is lower than the first voltage. The case is the same in the following embodiments, and the repeated description is omitted herein.

It should be noted that in the description of the embodiment of the present disclosure, Vdata represents both the data signal terminal and the level of the data signal. Similarly, Vint represents both the reset voltage terminal and the reset voltage, VDD represents both the first voltage terminal and the first voltage, and VSS represents both the second voltage terminal and the second voltage. The case is the same in the following embodiments, and the repeated description is omitted herein.

The pixel circuit 10 according to the above-mentioned embodiment of the present disclosure may not only alleviate the problem of a short-term residual image due to the retardation effect of the display device which adopts the above-mentioned pixel circuit, but also compensate the threshold voltage inside the drive circuit, such that the drive current for driving the light emitting element 600 is not affected by the threshold voltage, thereby improving the display effects of the display device which adopts this pixel circuit and prolonging the service life of the light emitting element 600.

Figure 3:
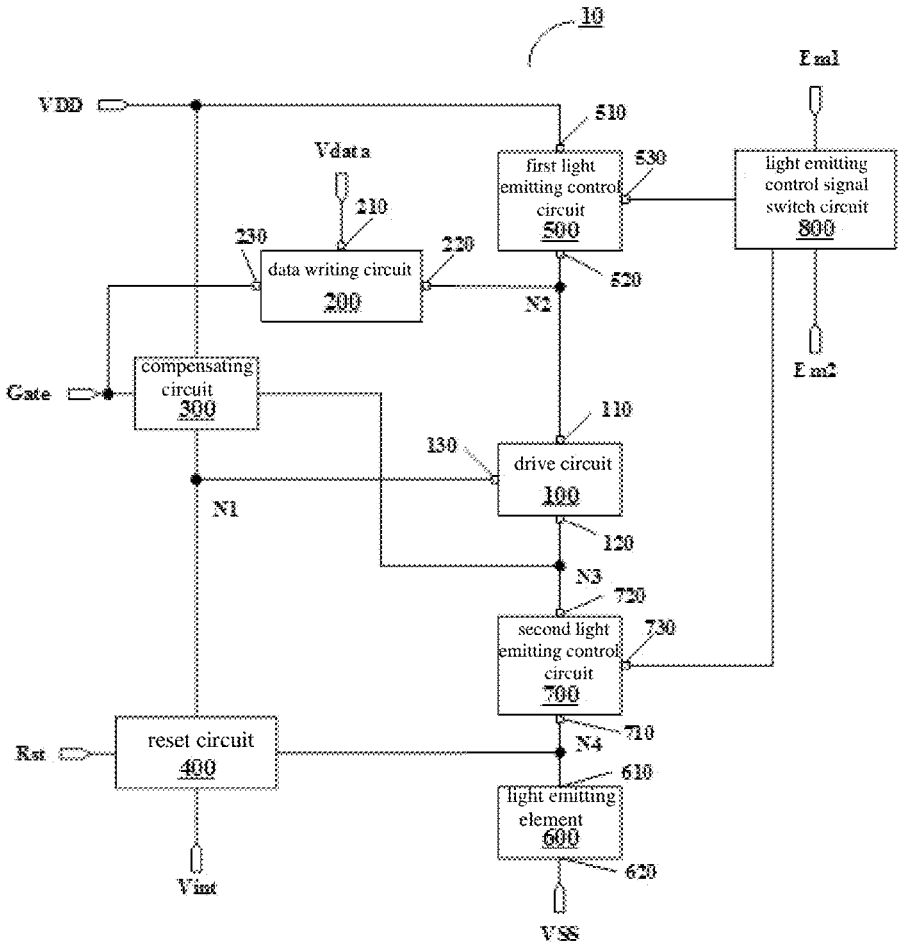
FIG. 3 is a schematic block diagram of another pixel circuit according to at least an embodiment of the present disclosure.

For example, as shown in FIG. 3, in another example of the present embodiment, the pixel circuit 10 may further include a light emitting control signal switch circuit 800.

For example, the light emitting control signal switch circuit 800 is coupled to the first light emitting control terminal Em1, the second light emitting control terminal Em2, the control terminal 530 of the first light emitting control circuit 500 and the control terminal 730 of the second light emitting control circuit 700, and is configured to apply the first light emitting control signal and the second light emitting control signal to the control terminal 530 of the first light emitting control circuit 500 and the control terminal 730 of the second light emitting control circuit 700 alternately in response to the light emitting control switch signal. For example, in different examples, there may be one or more light emitting control switch signals.

For example, the light emitting control signal switch circuit 800 may apply the first light emitting control signal to the control terminal 530 of the first light emitting control circuit 500 in response to the light emitting control switch signal, and apply the second light emitting control signal to the control terminal 730 of the second light emitting control circuit 700, such that when the reset voltage Vint is applied to the gate of the drive transistor by the reset circuit 400, and the potential of the source of the drive transistor is discharged to Vint-Vth to turn off the drive transistor, at this stage, the voltage $V_{GS}$ between the gate and source of the drive transistor satisfies: $|V_{GS}|<|Vth|$, so that the drive transistor is in an off-bias state with $V_{GS}$ being constantly biased. With this configuration, the drive transistor starts from the off-bias state with $V_{GS}$ being constantly biased and enters for example, the data writing and compensating stage, regardless of whether the data signal of the former frame is in a black state or a white state, thereby alleviating the problem of a short-term residual image due to the retardation effect of the display device which adopts the above-mentioned pixel circuit.

For example, the light emitting control signal switch circuit 800 may apply the second light emitting control signal to the control terminal 530 of the first light emitting control circuit 500 in response to the light emitting control switch signal, and apply the first light emitting control signal to the control terminal 730 of the second light emitting control circuit 700, such that when the reset voltage Vint is applied to the gate of the drive transistor by the reset circuit 400, and the first voltage VDD is applied to the source of the drive transistor, thus at this stage, the voltage $V_{GS}$ between the gate and source of the drive transistor satisfies: $|V_{GS}|>|Vth|$, so that the drive transistor is in an on-bias state with $V_{GS}$ being constantly biased. With this configuration, the drive transistor starts from the on-bias state with $V_{GS}$ being constantly biased and enters for example, the data writing and compensating stage, regardless of whether the data signal of the former frame is in a black state or a white state, thereby alleviating the problem of a short-term residual image due to the retardation effect of the display device which adopts the traditional pixel circuit.

In a display panel, the pixel circuit 10 according to the embodiment of the present disclosure solves the problem of a short-term residual image by not only the off-bias state with a voltage being constantly biased, but also the on-bias state with a voltage being constantly biased.

Figure 4:
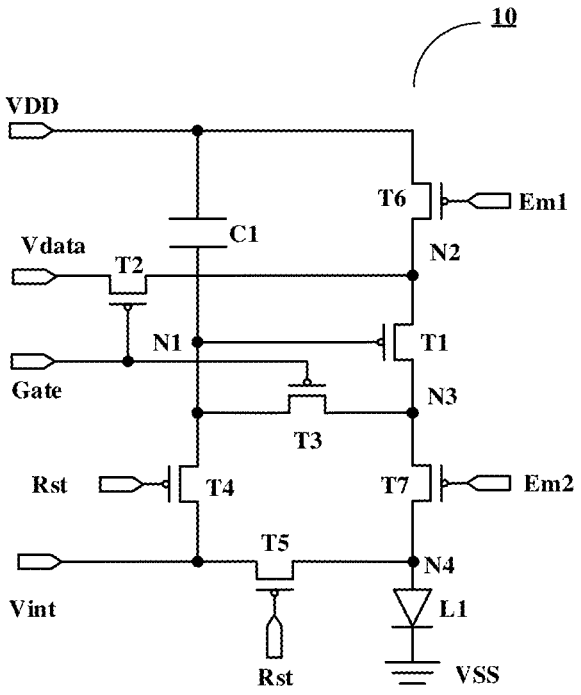
FIG. 4 is a circuit diagram of an implementation of the pixel circuit shown in FIG. 2.

For example, the pixel circuit 10 shown in FIG. 2 may be implemented by the pixel circuit shown in FIG. 4. As shown in FIG. 4, the pixel circuit 10 includes: first to seventh transistors T1, T2, T3, T4, T5, T6, T7, a capacitor C1 and a light emitting element L1. For example, the first transistor T1 is used as the drive transistor, and the second to seventh transistors are used as switch transistors. For example, as the light emitting element L1, various types of OLED may be used, for example, top emitting type, bottom emitting type, and double-side emitting type, or the like, and the OLEDs may emit red light, green light, blue light or white light, which is not limited in the embodiments of the present disclosure.

For example, as shown in FIG. 4, in more detail, the drive circuit 100 may be implemented by the first transistor T1. The gate of the first transistor T1 is used as the control terminal 130 of the drive circuit 100, and is coupled to the first node N1; the first electrode of the first transistor T1 is used as the first terminal 110 of the drive circuit 100 and is coupled to the second node N2; the second electrode of the first transistor T1 is used as the second terminal 120 of the drive circuit 100, and is coupled to the third node N3. It should be noted that the drive circuit 100 is not limited thereto, but may also be a circuit consisting of other components. For example, the drive circuit 100 may have two groups of drive transistors, for example, which may be switched as required.

The data writing circuit 200 may be implemented by the second transistor T2. The gate of the second transistor T2 is used as the control terminal 230 of the data writing circuit 200, and is configured to be coupled to the scan line (scan signal terminal Gate) to receive the scan signal. The first electrode of the second transistor T2 is used as the first terminal 210 of the data writing circuit 200, and is configured to be coupled to the data line (data signal terminal Vdata) to receive the data signal. The second electrode of the second transistor T2 is used as the second terminal 220 of the data writing circuit 200 and is coupled to the second node N2. It should be noted that the data writing circuit 200 is not limited thereto, but may also be a circuit consisting of other components. For example, there may be two groups of data writing circuits 200, for example, which may be switched as required.

The compensating circuit 300 may be implemented by the third transistor T3 and the capacitor C1. The gate of the third transistor T3 is configured to be coupled to the scan line (scan signal terminal Gate) to receive the scan signal. The first electrode of the third transistor T3 is coupled to the control terminal 130 (first node N1) of the drive circuit 100, the second electrode of the third transistor is coupled to the second terminal 120 (third node N3) of the drive circuit 100; the first electrode of the capacitor C1 is coupled to the control terminal 130 of the drive circuit 100, the second electrode of the capacitor C1 is configured to be coupled to the first voltage terminal VDD. It should be noted that the compensating circuit 300 is not limited thereto, but may also be a circuit consisting of other components. For example, there may be two groups of compensating circuits 300, for example, which may be switched as required.

The first terminal 610 (herein an anode) of the light emitting element L1 is coupled to the fourth node N4, and is configured to receive the drive current from the second terminal 120 of the drive circuit 100. The second terminal 620 (herein the cathode) of the light emitting element L1 is configured to be coupled to the second voltage terminal VSS to receive the second voltage. For example, the second voltage terminal may be grounded, i.e., VSS may be 0V.

The reset circuit 400 may be implemented by the fourth transistor T4 and the fifth transistor T5. The gate of the fourth transistor T4 is configured to be coupled to the reset control line (reset control terminal Rst) to receive the reset signal. The first electrode of the fourth transistor T4 is coupled to the control terminal 130 (first node N1) of the drive circuit 100, and the second electrode of the fourth transistor T4 is configured to be coupled to the reset voltage terminal Vint to receive the reset voltage; the gate of the fifth transistor T5 is configured to be coupled to the reset control line to receive the reset signal, the first electrode of the fifth transistor T5 is coupled to the first terminal 610 of the light emitting element L1, and the second electrode of the fifth transistor T5 is configured to be coupled to the reset voltage terminal Vint to receive the reset voltage. It should be noted that the reset circuit 400 is not limited thereto, but may also be a circuit consisting of other components. For example, there may be two groups of reset circuits 4000, for example, which may be switched as required.

The first light emitting control circuit 500 may be implemented by the sixth transistor T6. The gate of the sixth transistor T6 is used as the control terminal 530 of the first light emitting control circuit 500, and is configured to be coupled to the first light emitting control terminal Em1 to receive the first light emitting control signal. The first electrode of the sixth transistor T6 is used as the first terminal of the first light emitting control circuit 500, and is configured to be coupled to the first voltage terminal VDD to receive the first voltage. The second electrode of the sixth transistor T6 is used as the second terminal of the first light emitting control circuit 500 and is coupled to the first terminal 110 (second node N2) of the drive circuit. It should be noted that the first light emitting control circuit 500 is not limited thereto, but may also be a circuit consisting of other components. For example, there may be two groups of first light emitting control circuits 500, for example, which may be switched as required.

The second light emitting control circuit 700 may be implemented by the seventh transistor T7. The gate of the seventh transistor T7 is used as the control terminal 730 of the second light emitting control circuit 700, and is coupled to the second light emitting control terminal Em2 of the second light emitting control line to receive the second light emitting control signal. The first electrode of the seventh transistor T7 is used as the second terminal 720 of the second light emitting control circuit 700 and is coupled to the first terminal 610 (fourth node N4) of the light emitting element L1. The second electrode of the seventh transistor T7 is used as the first terminal 710 of the second light emitting control circuit 700 and is coupled to the second terminal 120 (third node N3) of the drive circuit 100. It should be noted that, the second light emitting control circuit 700 is not limited thereto, but may also be a circuit consisting of other components. For example, there may be two groups of second light emitting control circuits 700, for example, which may be switched as required.

In the explanation of the present disclosure, the first node N1, the second node N2, the third node N3 and the fourth node N4 do not represent actual components, but represent junctions of related electric connections in the circuit diagram.

Figure 5:
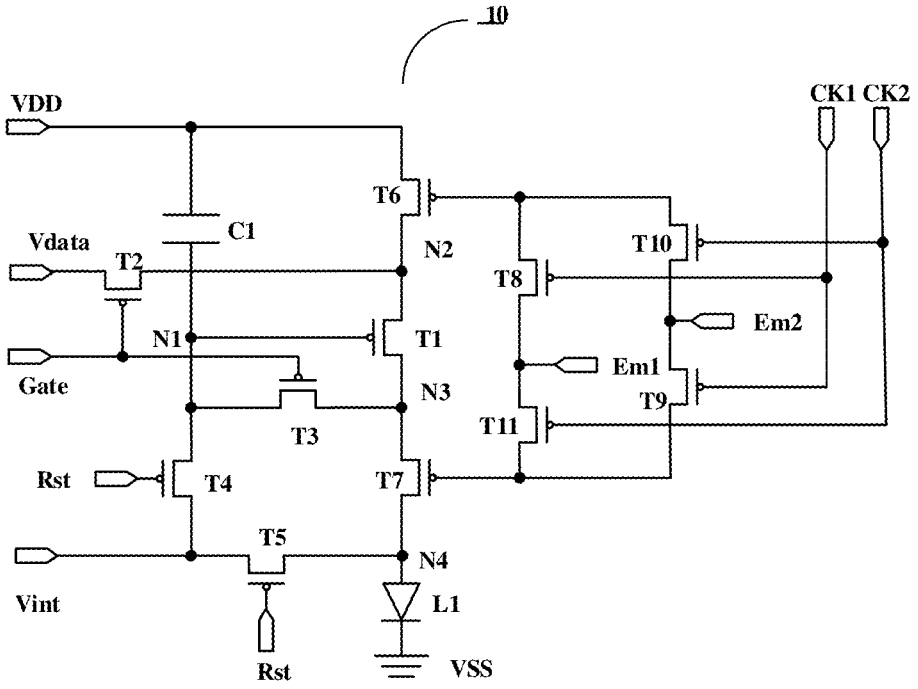
FIG. 5 is a circuit diagram of an implementation of the pixel circuit shown in FIG. 3.

FIG. 5 is a schematic diagram of another pixel circuit according to at least an embodiment of the present disclosure. The pixel circuit shown in FIG. 3 may be implemented by the pixel circuit structure shown in FIG. 5. The pixel circuit shown in FIG. 5 is substantially the same as the pixel circuit shown in FIG. 4, except that the pixel circuit 10 shown in FIG. 5 further includes a light emitting control signal switch circuit 800 which is implemented by the eighth to eleventh transistors T8, T9, T10 and T11.

For example, as shown in FIG. 5, in more detail, the light emitting control signal switch circuit 800 may be implemented by the eighth to eleventh transistors T8, T9, T10 and T11. The gate of the eighth transistor T8 receives the first light emitting control switch signal CK1, the first electrode of the eighth transistor T8 is coupled to the first light emitting control signal terminal Em1, and the second electrode of the eighth transistor T8 is coupled to the control terminal 530 of the first light emitting control circuit 500. The gate of the ninth transistor T9 receives the first light emitting control switch signal CK1, the first electrode of the ninth transistor T9 is coupled to the second light emitting control signal terminal Em2, and the second electrode of the ninth transistor T9 is coupled to the control terminal 730 of the second light emitting control circuit 700. The gate of the tenth transistor T10 receives the second light emitting control switch signal CK2, the first electrode of the tenth transistor T10 is coupled to the second light emitting control signal terminal Em2, and the second electrode of the tenth transistor T10 is coupled to the control terminal 530 of the first light emitting control circuit 500. The gate of the eleventh transistor T11 receives the second light emitting control switch signal CK2, the first electrode of the eleventh transistor T11 is coupled to the first light emitting control signal terminal Em1, and the second electrode of the eleventh transistor T11 is coupled to the control terminal 730 of the second light emitting control circuit 700. It should be noted that, the light emitting control signal switch circuit 800 is not limited thereto, but may also be a circuit consisting of other components. For example, there may be two groups of light emitting control signal switch circuits 800, for example, which may be switched as required.

It should be noted that in the description of the embodiments of the present disclosure, CK1 not only represents the first light emitting control switch signal terminal, but also the level of the first light emitting control switch signal; similarly, CK2 not only represents the second light emitting control switch signal terminal, but also the level of the second light emitting control switch signal.

The working principle of the pixel circuit 10 shown in FIG. 5 will be explained below in combination with the signal timing diagram shown in FIG. 6, and herein the description is made by taking a P-type transistor as an example, but the embodiment of the present disclosure is not limited thereto. For example, the P-type transistor is turned on in response to a low-level signal, and is turned off in response to a high-level signal. The same case applies to the following embodiments and is not repeated herein.

Figure 6:
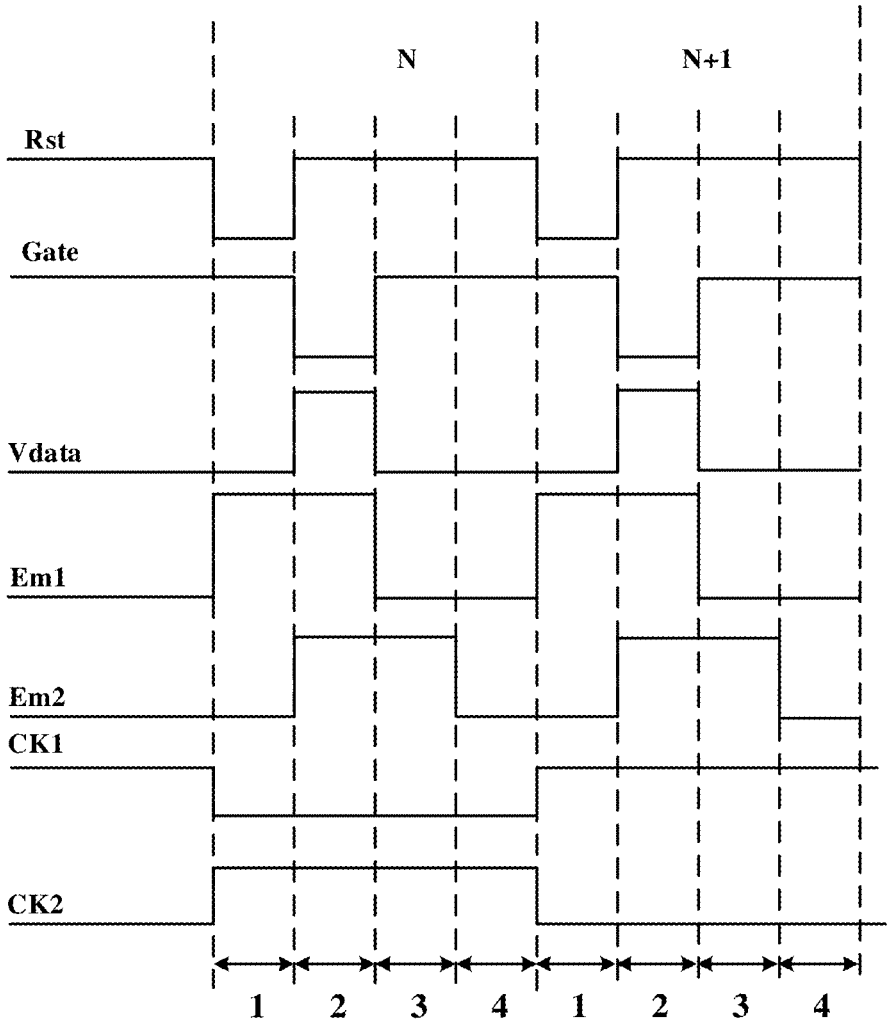
FIG. 6 is a timing diagram of a driving method according to at least an embodiment of the present disclosure.

FIG. 6 shows a process for displaying an Nth frame image (N is an integer larger than or equal to 1) and a process for displaying a (N+1)th frame image. As shown in FIG. 6, the process for displaying each frame image includes four stages: an initialization stage 1, a data writing and compensating stage 2, a pre-light emitting stage 3 and a light emitting stage 4. FIG. 6 shows a timing waveform of each signal at each stage.

It should be noted that FIGS. 7A to 7D are schematic diagrams of the pixel circuit shown in FIG. 5 in the process of displaying the Nth frame image respectively; and FIGS. 8A to 8D are schematic diagrams of the pixel circuit shown in FIG. 5 in the process of displaying the (N+1)th frame image respectively.

Figure 7A:
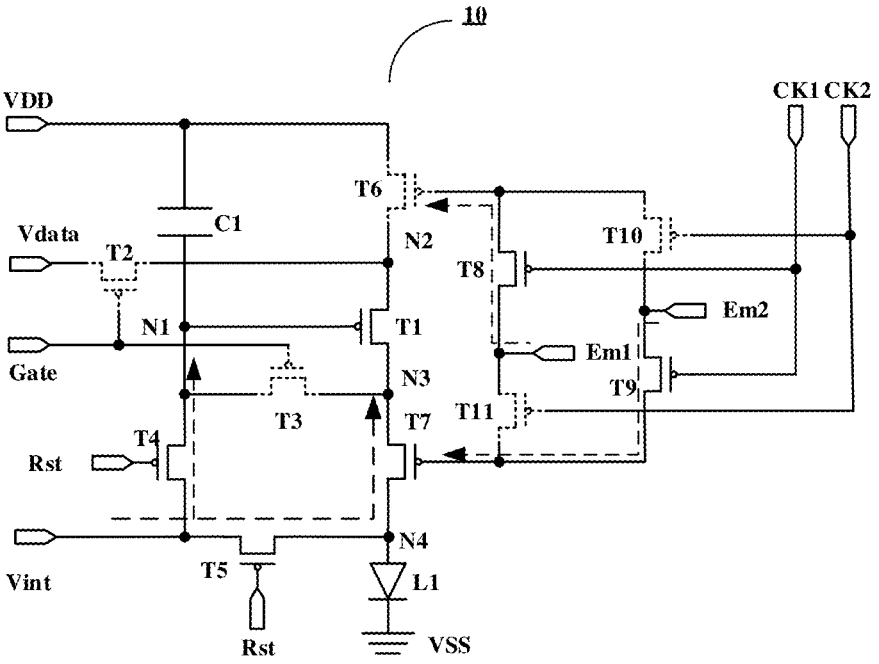
FIGS. 7A to 7D are schematic circuit diagrams of the pixel circuit shown in FIG. 5 at four stages in a process of displaying a Nth frame image in FIG. 6 respectively.
Figure 7B:
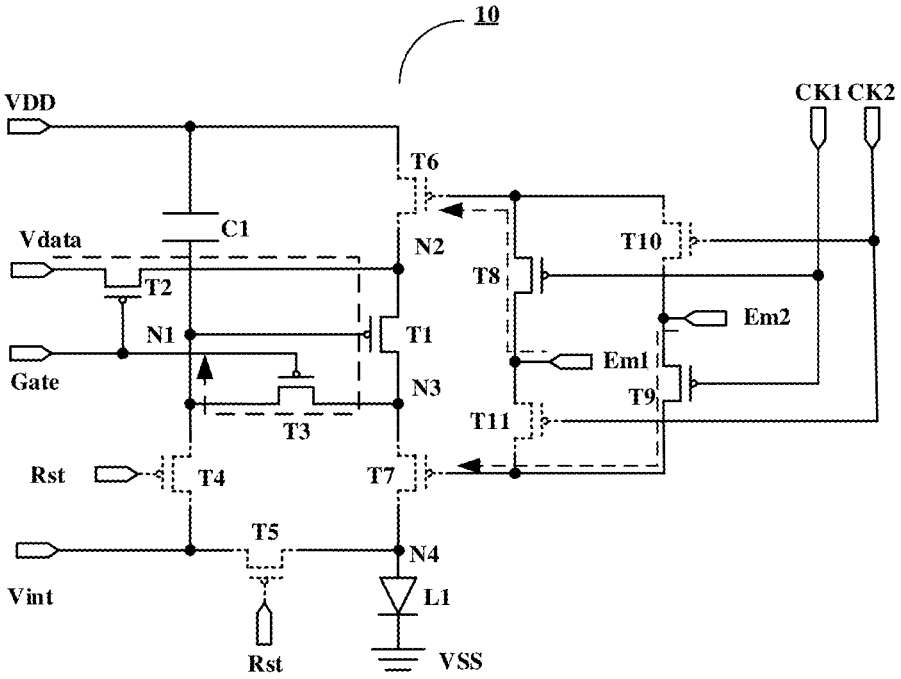
Figure 7C:
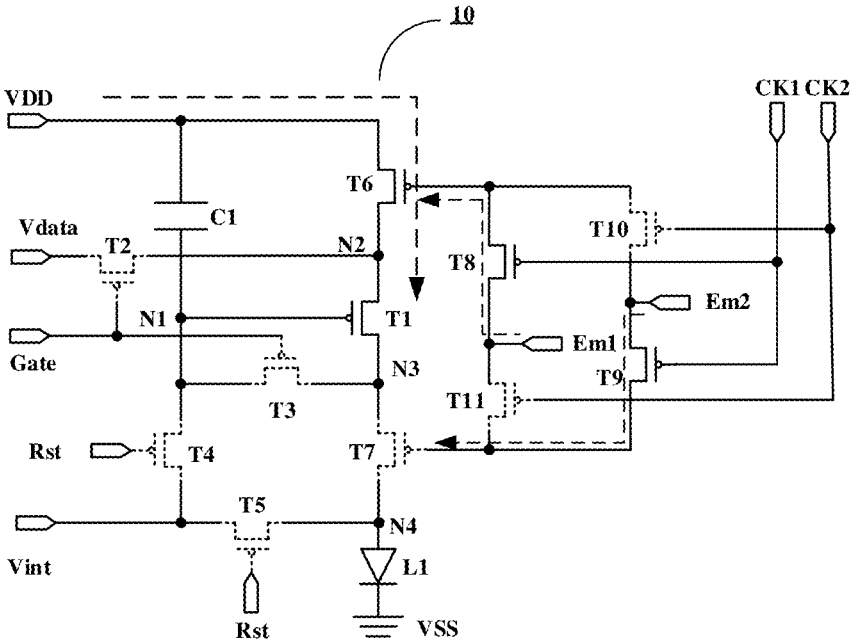
Figure 7D:
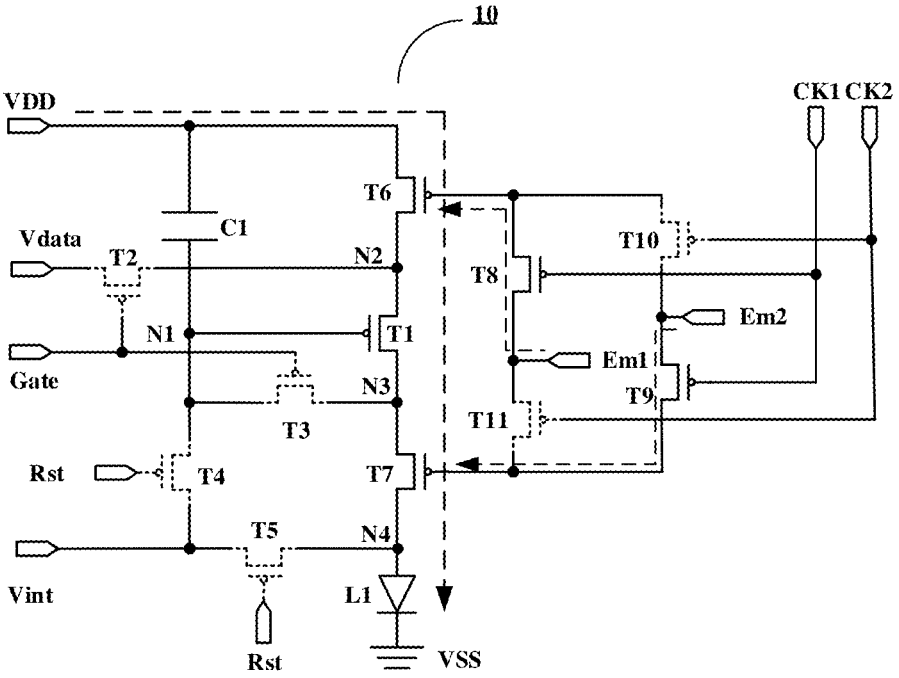

FIG. 7A is a schematic diagram in the case where the pixel circuit shown in FIG. 5 is at the initialization stage 1 in the process of displaying an Nth frame image, FIG. 7B is a schematic diagram in the case where the pixel circuit shown in FIG. 5 is at the data writing and compensating stage 2 in the process of displaying an Nth frame image, FIG. 7C is a schematic diagram in the case where the pixel circuit shown in FIG. 5 is at the pre-light emitting stage 3 in the process of displaying an Nth frame image, and FIG. 7D is a schematic diagram in the case where the pixel circuit shown in FIG. 5 is at the light emitting stage 4 in the process of displaying an Nth frame image. For example, a falling edge of the second light emitting control signal may also be synchronized with that of the first light emitting control signal, thereby entering the light emitting stage 4 directly from the data writing and compensating stage 2.

Figure 8A:
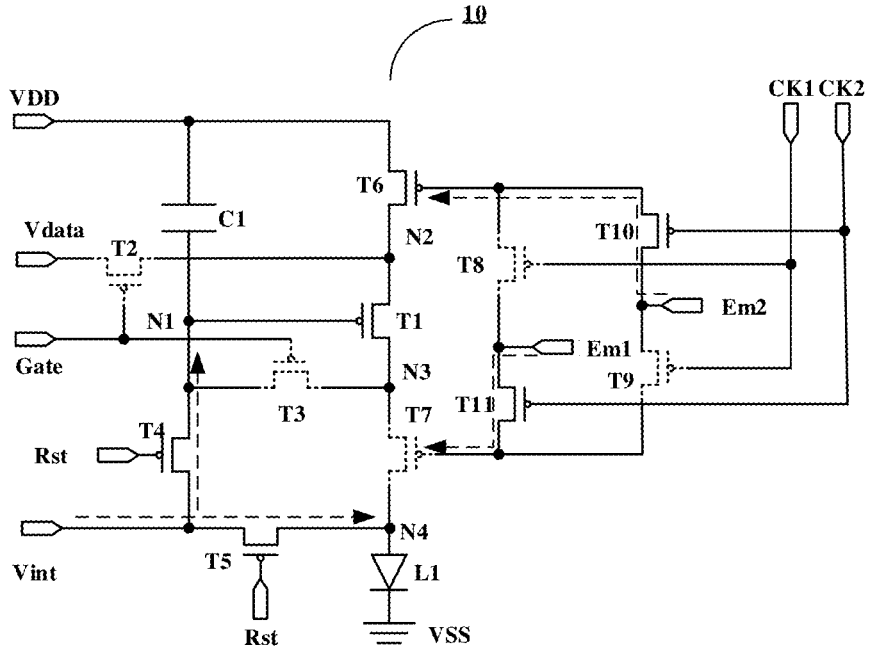
FIGS. 8A to 8D are circuit schematic diagrams of the pixel circuit shown in FIG. 5 at four stages in a process of displaying a (N+1)th frame image in FIG. 6 respectively.
Figure 8B:
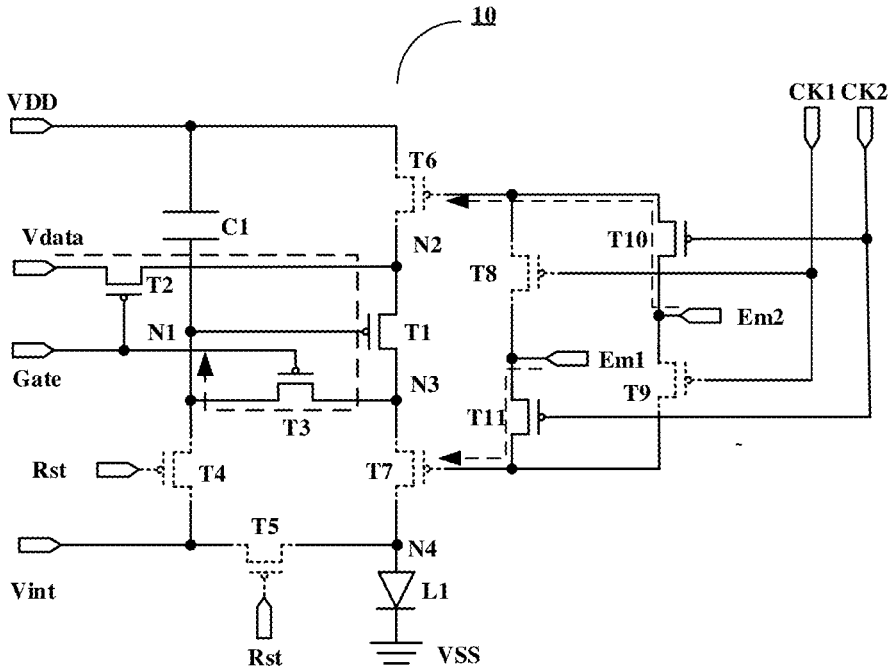
Figure 8C:
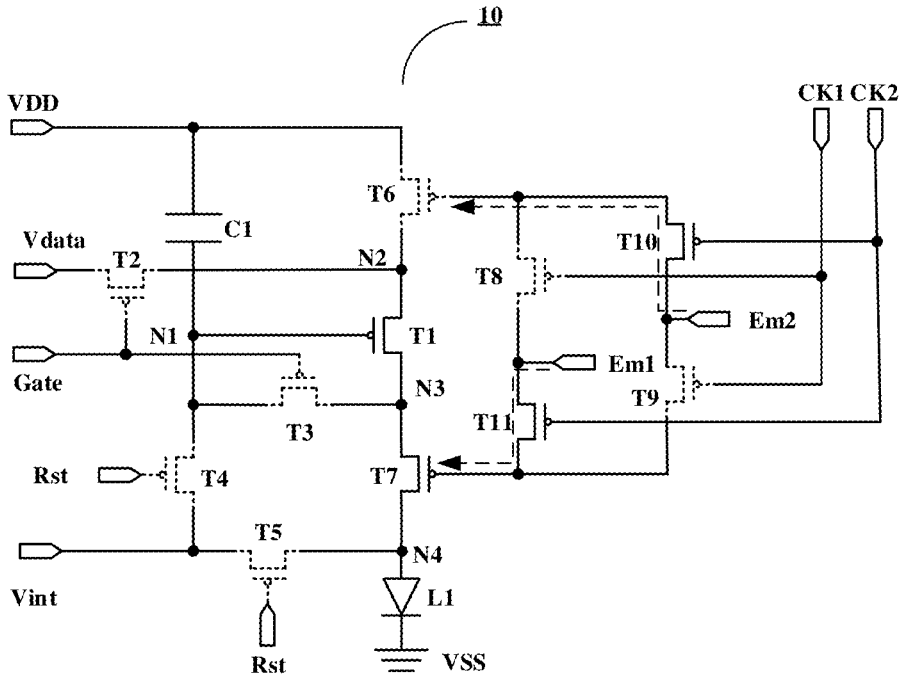
Figure 8D:
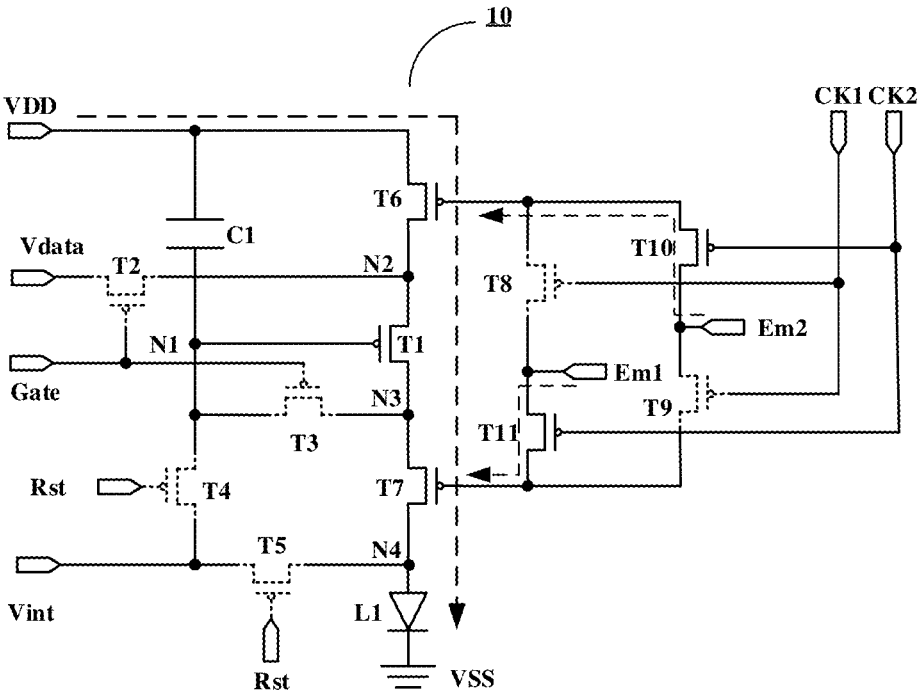

FIG. 8A is a schematic diagram in the case where the pixel circuit shown in FIG. 5 is at the initialization stage 1 in the process of displaying an (N+1)th frame image, FIG. 8B is a schematic diagram in the case where the pixel circuit shown in FIG. 5 is at the data writing and compensating stage 2 in the process of displaying an (N+1)th frame image, FIG. 8C is a schematic diagram in the case where the pixel circuit shown in FIG. 5 is at the pre-light emitting stage 3 in the process of displaying an (N+1)th frame image, and FIG. 8D is a schematic diagram in the case where the pixel circuit shown in FIG. 5 is at the light emitting stage 4 in the process of displaying an (N+1)th frame image.

Additionally, in FIGS. 7A to 8D, dashed lines mean that the transistors are in OFF states at the corresponding stage, and dashed lines with arrows mean current directions of the pixel circuit at the corresponding stage. In FIGS. 7A to 8B, the description is made by taking the P-type transistor as an example, i.e., the gate of each transistor is turned on in case of a low level, and turned off in case of a high level.

In the process of displaying the Nth frame image, the first light emitting control switch signal (provided by the first light emitting control switch signal terminal CK1) is input to turn on the light emitting control signal switch circuit, the first light emitting control signal is applied to the control terminal 530 of the first light emitting control circuit 500, and the second light emitting control signal is applied to the control terminal 730 of the second light emitting control circuit 700.

As shown in FIGS. 6, 7A to 7D, in the process of displaying the Nth frame image, the eighth transistor T8 and the ninth transistor T9 are turned on by the low level of the first light emitting control switch signal CK1; and the tenth transistor T10 and the eleventh transistor T11 are turned off by the high level of the second light emitting control switch signal CK2. As shown in FIGS. 7A to 7D, a light emitting control signal switch path is formed (as shown by part of the light emitting control signal switch circuit indicated by dashed line with an arrow in FIGS. 7A to 7D). Since the eighth transistor T8 is turned on, the first light emitting control signal may be applied to the gate of the sixth transistor T6, and since the ninth transistor T9 is turned on, the second light emitting control signal may be applied to the gate of the seventh transistor T7.

At the initialization stage 1, the reset signal and the second light emitting control signal are input to turn on the reset circuit 400 and the second light emitting control circuit 700 to apply the reset voltage to the control terminal 130 and the second terminal 120 of the drive circuit 100 and the first terminal 610 of the light emitting element 600.

As shown in FIGS. 6 and 7A, at the initialization stage 1, the fourth transistor T4 and the fifth transistor T5 are turned on by the low level of the reset signal, and the seventh transistor T7 is turned on by the low level of the second light emitting control signal; meanwhile, the second transistor T2 and the third transistor T3 are turned off by the high level of the scan signal, and the sixth transistor T6 is turned off by the high level of the first light emitting control signal.

As shown in FIG. 7A, at the initialization stage 1, a reset path (shown by the dashed line with an arrow in FIG. 7A) is formed. Since the fourth transistor T4 is turned on, the reset voltage Vint is applied to the gate of the first transistor T1. Since the fifth transistor T5 and the seventh transistor T7 are turned on, the reset voltage Vint may be applied to the second electrode of the first transistor T1 and the light emitting element L1, thereby resetting the first node N1 and the light emitting element L1. Therefore, the potential of the first node N1 after the initialization stage 1 is the reset voltage Vint (a low-level signal, for example, which may be grounded, or other low-level signals). At this stage, since the first transistor T1 and the seventh transistor T7 are turned on, the sixth transistor T6 is turned off. According to the characteristics of the first transistor T1, the potential of the source of the first transistor T1 is discharged to Vint-Vth to be turned off. Therefore, at this stage, the voltage $V_{GS}$ between the gate and the source of the first transistor T1 satisfies: $|V_{GS}|<|Vth|$, such that the first transistor T1 is in an off-bias state with $V_{GS}$ being constantly biased. With this configuration, the first transistor T1 starts from the off-bias state with $V_{GS}$ being constantly biased and enters the data writing and compensating stage 2, regardless of whether the data signal of the former frame is in a black state or a white state, thereby alleviating the problem of a short-term residual image due to the retardation effect of the display device which adopts the pixel circuit 10.

After the initialization stage 1, the potential of the first node N1 is the reset voltage Vint, and the potential of the second node N2 is Vint-Vh. At the initialization stage 1, the capacitor C1 is reset, such that the voltage stored in the capacitor C1 is discharged, and the data signal at subsequent stages may be stored in the capacitor C1 more rapidly and reliably; meanwhile, the third node N3 and the light emitting element L1 are also reset, such that the light emitting element L1 does not emit light before the light emitting stage 4, and the display effects such as a contrast of the display device which uses the above-mentioned pixel circuit is improved.

At the data writing and compensating stage 2, the scan signal and the data signal are input to turn on the data writing circuit 200, the drive circuit 100 and the compensating circuit 300. The data writing circuit 200 writes the data signal to the drive circuit 100 and the compensating circuit 300 compensates the drive circuit 100.

As shown in FIGS. 6 and 7B, at the data writing and compensating stage 2, the second transistor T2 and the third transistor T3 are turned on by the low level of the scan signal; meanwhile, the fourth transistor T4 and the fifth transistor T5 are turned off by the high level of the reset signal, the sixth transistor T6 is turned off by the high level of the first light emitting control signal, and the seventh transistor T7 is turned off by the high level of the second light emitting control signal.

As shown in FIG. 7B, at the data writing and compensating stage 2, a data writing and compensation path (shown by the dashed line with an arrow in FIG. 7B) is formed, and the data signal charges the first node N1 (that is, to charge the capacitor C1) through the second transistor T2, the first transistor T1 and the third transistor T3, i.e., the potential of the first node N1 becomes larger. It is easily understood that the potential of the second node N2 is kept to be Vdata, and at the same time, according to the characteristics of the first transistor T1, when the potential of the first node N1 is increased to Vdata+Vth, the first transistor T1 is turned off and the charging process ends. It should be noted that Vdata represents a voltage value of the data signal, and Vth represents the threshold voltage of the first transistor. Since in the present embodiment, the description is made by taking the P-type transistor as an example, the threshold voltage Vth here may be negative.

After the data writing stage 2, the potentials of the first node N1 and the third node N3 are both Vdata+Vth. That is, the voltage information about the data signal and the threshold voltage Vth is stored in the capacitor C1 to be used to provide gray-level display data and compensate the threshold voltage of the first transistor T1 at the subsequent light emitting stage.

At the pre-light emitting stage 3, the first light emitting control signal is input to turn on the first light emitting control circuit 500 and the drive circuit 100, and the first light emitting control circuit 500 applies the first voltage to the first terminal 110 of the drive circuit 100.

As shown in FIGS. 6 and 7C, at the pre-light emitting stage 3, the sixth transistor T6 is turned on by the low level of the first light emitting control signal; meanwhile, the second transistor T2 and the third transistor T3 are turned off by the high level of the scan signal, the fourth transistor T4 and the fifth transistor T5 are turned off by the high level of the reset signal, and the seventh transistor T7 is turned off by the high level of the second light emitting control signal.

As shown in FIG. 7C, at the pre-light emitting stage 3, a pre-light emitting path (shown by the dashed line with an arrow in FIG. 7C) is formed. The first voltage charges the second node N2 through the sixth transistor T6, and the potential of the second node N2 is changed from Vdata to the first voltage VDD. Since at this stage, the seventh transistor T7 is turned off, preparation is made for the light emission of the light emitting element L1 at the next stage.

At the light emitting stage 4, the first light emitting control signal and the second light emitting control signal are input to turn on the first light emitting control circuit 500, the second light emitting control circuit 700 and the drive circuit 100. The second light emitting control circuit 700 applies the drive current to the light emitting element L1 to make the light emitting element L1 emit light.

As shown in FIGS. 6 and 7D, at the light emitting stage 4, the sixth transistor T6 is turned on by the low level of the first light emitting control signal, the seventh transistor T7 is turned on by the low level of the second light emitting control signal; meanwhile, the second transistor T2 and the third transistor T3 are turned off by the high level of the scan signal, and the fourth transistor T4 and the fifth transistor T5 are turned off by the high level of the reset signal. Meanwhile, the potential of the first node N1 is Vdata+Vth, the potential of the second node N2 is VDD, and the first transistor T1 at this stage is kept being turned on.

As shown in FIG. 7D, at the light emitting stage 4, a path for driving light emission is formed (shown by the dashed line with an arrow in FIG. 7D). The light emitting element L1 may emit light under the action of the drive current flowing through the first transistor T1.

Specifically, the value of the drive current $I_{L1}$ flowing through the light emitting element L1 may be obtained according to the following formula:

$$IL1 = K(V_{GS} - Vth)^2 = K[(Vdata + Vth - VDD) - Vth]^2 = K(Vdata - VDD)^2 \text{ where } K = W * C_{OX} * U / L.$$

In the above-mentioned formula, Vth represents the threshold voltage of the first transistor T1, $V_{GS}$ represents the voltage between the gate and source (the first electrode herein) of the first transistor T1, and K is a constant value related to the drive transistor itself. From the above-mentioned formula for calculating $I_{L1}$, the drive current $I_{L1}$ flowing through the light emitting element L1 is no longer related to the threshold voltage Vth of the first transistor T1, thereby compensating this pixel circuit, solving the problem of threshold voltage drift due to the manufacture process and the long-time operation of the drive transistor (in the embodiment of the present disclosure, the first transistor T1), eliminating the influence of the drive transistor on the drive current $I_{L1}$, and improving the display effects of the display device which the pixel circuit.

As shown in FIGS. 8A to 8D, in the process of displaying the (N+1)th frame image, the second light emitting control switch signal (the second light emitting control switch signal terminal CK2) is input to turn on the light emitting control signal switch circuit, the second light emitting control signal is applied to the control terminal 530 of the first light emitting control circuit 500, and the first light emitting control signal is applied to the control terminal 730 of the second light emitting control circuit 700.

As shown in FIGS. 6, and 8A to 8D, in the process of displaying the (N+1)th frame image, the tenth transistor T10 and the eleventh transistor T11 are turned on by the low level of the second light emitting control switch signal CK2; and the eighth transistor T8 and the ninth transistor T9 are turned off by the high level of the first light emitting control switch signal CK1. As shown in FIGS. 8A to 8D, a light emitting control signal switch path is formed (as shown by part of the light emitting control signal switch circuit indicated by the dashed line with an arrow in FIGS. 8A to 8D). Since the tenth transistor T10 is turned on, the second light emitting control signal may be applied to the gate of the sixth transistor T6, and since the eleventh transistor T11 is turned on, the first light emitting control signal may be applied to the gate of the seventh transistor T7.

The working principle of displaying the (N+1)th frame image is substantially the same as that of displaying the Nth frame image, except that: at the initialization stage 1 of the process of displaying the (N+1)th frame image, the sixth transistor T6 is turned on by the low level of the second light emitting control signal, and the seventh transistor T7 is turned off by the high level of the first light emitting control signal. Therefore, at this stage, since the sixth transistor T6 is turned on, the potential of the source of the first transistor T1 is charged to the first voltage VDD, so the voltage $V_{GS}$ between the gate (that is, the first node N1) and source (that is, the second node N2) of the first transistor T1 satisfies: $|V_{GS}|>|Vth|$, so that the first transistor T1 is in an on-bias state with $V_{GS}$ being constantly biased. With this configuration, the first transistor T1 starts from the on-bias state with $V_{GS}$ being constantly biased and enters the data writing and compensating stage 2, regardless of whether the data signal of the former frame is in a black state or a white state, thereby alleviating the problem of a short-term residual image due to the retardation effect of the display device which adopts the pixel circuit 10.

In addition, as shown in FIG. 8C, at the pre-light emitting stage 3 in the process of displaying the (N+1)th frame image, the sixth transistor T6 is turned off by the high level of the second light emitting control signal, the seventh transistor T7 is turned on by the low level of the first light emitting control signal, and preparation is made for the light emission of the light emitting element L1 at the next stage.

The working principle of the pixel circuit 10 shown in FIG. 4 is substantially the same as that of the pixel circuit shown in FIG. 5 and differs in that the pixel circuit 10 shown in FIG. 4 does not include the light emitting control signal switch circuit 800, so the control terminal 530 of the first light emitting control circuit 500 is coupled to the first light emitting control signal terminal Em1 directly, and the control terminal 730 of the second light emitting control circuit 700 is coupled to the second light emitting control signal terminal Em2, and the case of switching the Nth frame and the (N+1)th frame does not exist.

It should be noted that the transistor used in the embodiments of the present disclosure may be a thin film transistor, a field effect transistor or a switch device with same characteristics, and the embodiments of the present disclosure will be explained by taking the thin film transistor as an example. The source and drain of the transistor used herein may be symmetrical structurally, so there may be no difference between them structurally. In some embodiments of the present disclosure, in order to distinguish the drain from the source of the transistor, one of the drain and the source is referred to as a first electrode, and the other is referred to as a second electrode.

In addition, in the pixel circuit 10 shown in FIG. 5, it should be noted that the description is made by taking the P-type transistor as an example. At this point, the first electrode may be the drain and the second electrode may be the source. As shown in FIG. 5, the cathode of the light emitting element L1 in the pixel circuit 10 is coupled to the second voltage terminal VSS to receive the second voltage. For example, in a display panel, in a case where the pixel circuits 10 shown in FIG. 5 are arranged in an array, the cathode of the light emitting element L1 may be electrically connected to the same voltage terminal by means of a common-cathode connection.

The embodiment of the present disclosure includes, but is not limited to the configuration in FIG. 5. In another embodiment of the present disclosure, the light emitting control signal switch circuit may include only one light emitting control switch signal line.

Figure 9:
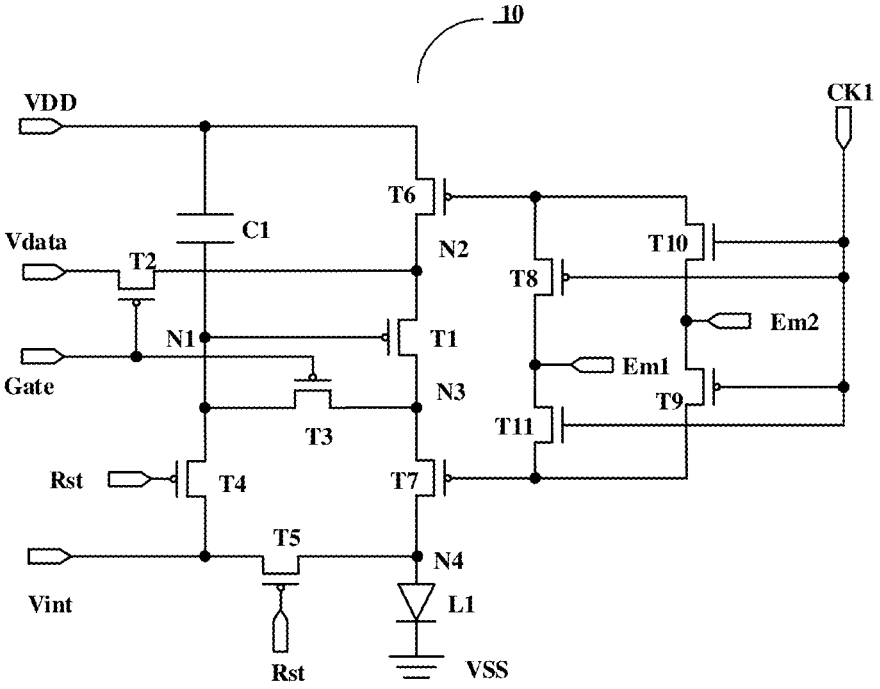
FIG. 9 is a circuit diagram of a pixel circuit according to at least an embodiment of the present disclosure.

For example, in one example, as shown in FIG. 9, as the transistor in the pixel circuit 10, both P-type transistor and N-type transistor may be used, as long as the terminals of the selected transistor are coupled to those of the corresponding transistor having corresponding polarities in the embodiment of the present disclosure. For example, as shown in FIG. 9, the first transistor to the ninth transistor T1-T9 are of the P-type, and the tenth transistor T10 and the eleventh transistor T11 are of the N-type. For example, the eighth transistor to the eleventh transistor T8-T11 are coupled to the first light emitting control switch signal terminal CK1 at the same time.

It should be noted that in the embodiments of the present disclosure, when the N-type transistor is used as the tenth transistor T10 and the eleventh transistor T11, IGZO (Indium Gallium Zinc Oxide) is used as an active layer of the thin film transistor. Compared with the usage of LTPS (Low Temperature Poly Silicon) or A-Si (for example, a-SiH) as the active layer of the thin film transistor, the size of the drive transistor may be reduced effectively and a leakage current may be prevented.

Figure 10:
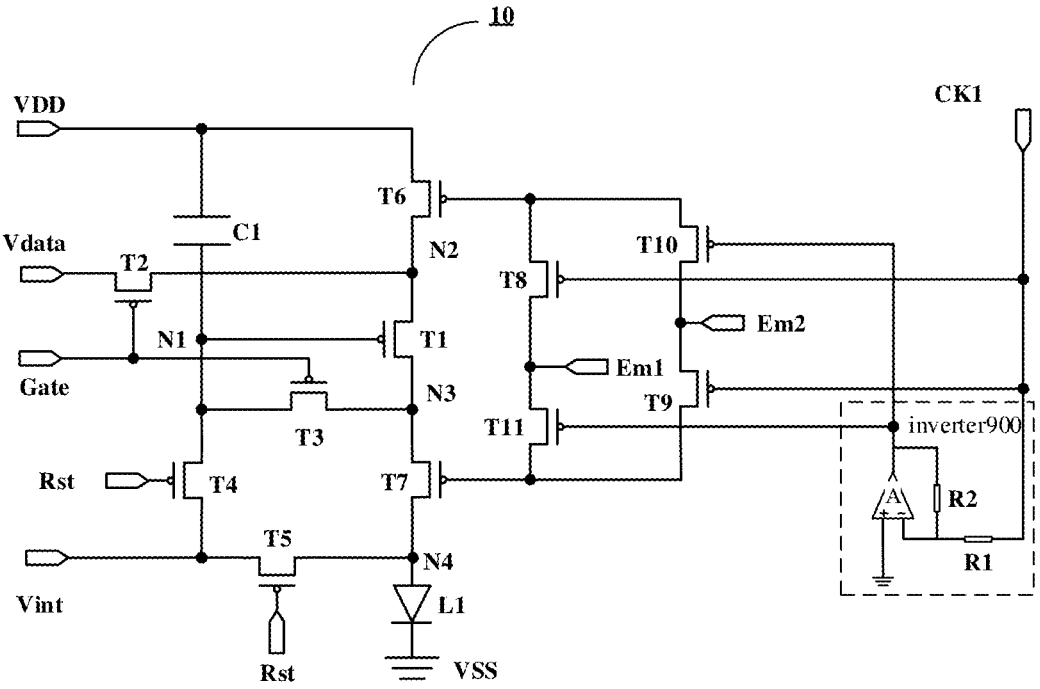
FIG. 10 is a circuit diagram of another pixel circuit according to at least an embodiment of the present disclosure.

For example, in another example, as shown in FIG. 10, the pixel circuit 10 may be implemented by connecting an inverter 900 between the gates of the tenth transistor T10 and the eleventh transistor T11 and the first light emitting control switch signal terminal CK1. For example, this inverter is implemented by an operational amplifier A, a first resistor R1 and a second resistor R2. It should be noted that the inverter 900 is not limited to the above-mentioned structure, and is not limited in the embodiment of the present disclosure. For example, this inverter 900 may be a TTL inverter or a CMOS inverter.

Figure 11:
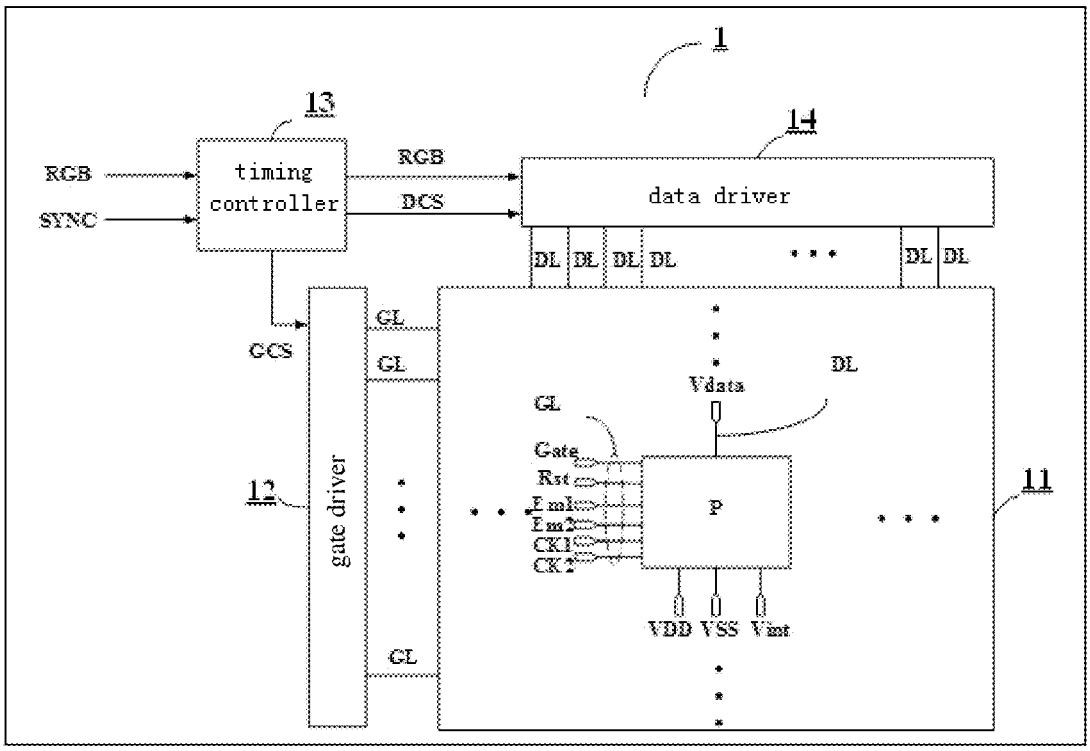
FIG. 11 is a schematic diagram of a display device according to at least an embodiment of the present disclosure.

At least an embodiment of the present disclosure further provides a display panel 11, as shown in FIG. 11. The display panel 11 is located in the display device 1, and includes a gate driver 12, a data driver 14 and a timing controller 13. This display panel 11 includes a plurality of pixel units P which are defined by intersecting scan lines GL and data lines DL; the gate driver 12 is used for driving a plurality of scan lines GL; the data driver 14 is used for driving the plural data lines DL; and the timing controller 13 is used for processing image data RGB input from outside the display device 1, providing the processed image data RGB to the data driver 14 and outputting the scan control signal GCS and the data control signal DCS to the gate driver 12 and the data driver 14, so as to control the gate driver 12 and the data driver 14.

For example, this display panel 11 includes a plurality of pixel units P arranged in an array, each of which includes the pixel circuit 10 according to any of the above-mentioned embodiments and a light emitting element (not shown in drawings), for example, the pixel circuit 10 shown in FIG. 5, or the pixel circuit as shown in FIG. 4. For example, the first terminal of the light emitting element is configured to receive the drive circuit from the second terminal 120 of the drive circuit 100 in the pixel circuit 10, and the second terminal of the light emitting element is configured to be coupled to the second voltage terminal VSS.

As shown in FIG. 11, the display panel 11 further includes a plurality of scan lines GL and a plurality of data lines DL. For example, the pixel units P are arranged in an area where the scan lines GL and the data lines DL intersect with each other. For example, as shown in FIG. 11, each pixel unit P is coupled to six scan lines GL (providing the scan signal, the reset control signal, the first light emitting control signal, the second light emitting control signal, the first light emitting control switch signal and the second light emitting control switch signal respectively), a data line DL, a first voltage line for providing a first voltage, a second voltage line for providing a second voltage, and a reset voltage line for providing a reset voltage. For example, the first voltage line or the second voltage line may be replaced with a corresponding plate-like common electrode (for example, a common anode or cathode). It should be noted that FIG. 11 only shows part of pixel units P, scan lines GL and data lines DL.

For example, the plurality of pixel units P is arranged in plural rows, the control terminal 230 of the data writing circuit 200 and the control terminal of the compensating circuit 300 of the pixel circuit of the n-th (n is an integer greater than or equal to 2) row of pixel units P are coupled to the same scan line GL, and the control terminal of the reset circuit 400 of the pixel circuit of the n-th row of pixel units P is coupled to another scan line GL. For example, the another scan line GL is further coupled to the control terminal 230 of the data writing circuit 200 and the control terminal of the compensating circuit 300 of the pixel circuit of the (n−1)th row of pixel units P. For example, each column of data lines DL is coupled to the first terminal 210 of the data writing circuit 200 in this column of pixel circuit 10 to provide data signals.

For another example, the display panel 11 may further include a plurality of reset control lines. For example, the plurality of pixel units P is arranged in plural rows, the control terminal of the data writing circuit 200 and the control terminal of the compensating circuit 300 of the pixel circuit 10 of a row of pixel units P are coupled to the same scan line GL, and the control terminal of the reset circuit 400 of the pixel circuit of a row of pixel units P is coupled to the same reset control line (reset control terminal Rst).

For example, in the case where the pixel circuit 10 includes a second light emitting control circuit 700, the display panel 11 further includes a plurality of light emitting control lines.

For example, the plurality of pixel units is arranged in plural rows, the control terminal 530 of the first light emitting control circuit 500 of the pixel circuit of the m-th (m is an integer greater than or equal to 1) row of pixel units P is coupled to the same light emitting control line, and the control terminal 730 of the second light emitting control circuit 700 of the pixel circuit of the m-th row of pixel units P is coupled to another light emitting control line. For example, the another light emitting control line is further coupled to the control terminal of the first light emitting control circuit 500 of the pixel circuit of the (m+1)th row of pixel units P.

For example, in the case where the pixel circuit 10 includes a light emitting control signal switch circuit 800, the display panel 11 further includes a plurality of light emitting control switch signal lines.

For example, in an example, a plurality of pixel units is arranged in plural rows, and the control terminal of the light emitting control signal switch circuit of the pixel circuit of the m-th row of pixel units is coupled to the same light emitting control switch signal line. For example, in another example, the control terminal of the light emitting control signal switch circuit of the pixel circuit of the m-th row of pixel units is coupled to two light emitting control switch signal lines. For example, a rising edge of the light emitting control switch signal provided by one of the two light emitting control switch signal lines corresponds to the falling edge of the light emitting control switch signal provided by the other of the two light emitting control switch signal lines.

For example, the gate driver 12 provides a plurality of selection signals to a plurality of scan lines GL according to the plurality of scan control signals GCS from the timing controller 13. The plurality of selection signals includes the scan signal, the first light emitting control signal, the second light emitting control signal and the reset signal. These signals are provided to each pixel unit P by the plurality of scan lines GL.

For example, the data driver 14 uses a reference gamma voltage to convert the digital image data RGB input from the timing controller 13 into the data signal according to a plurality of data control signals DCS from the timing controller 13. The data driver 14 provides the converted data signal to the plural data lines DL.

For example, the timing controller 13 processes the image data RGB externally input to match the size and resolution of the display panel 11, and then provides the processed image data to the data driver 14. The timing controller 13 uses a synchronizing signal (for example, dot clock DCLK, data enable signal DE, horizontal synchronizing signal Hsync and vertical synchronizing signal Vsync) input from outside the display device to generate a plurality of scan control signals GCS and a plurality of data control signals DCS. The timing controller 13 provides the generated scan control signals GCS and the data control signals DCS to the gate driver 12 and the data driver 14 respectively to control the gate driver 12 and the data driver 14.

For example, the data driver 14 may be coupled to a plurality of data lines DL to provide data signal Vdata, and may also be coupled to a plurality of first voltage lines, a plurality of second voltage lines and a plurality of reset voltage lines to provide a first voltage, a second voltage and a reset voltage respectively.

For example, the gate driver 12 and the data driver 14 may be implemented by semiconductor chips. This display device 1 may further include other components, for example, a signal decoding circuit, a voltage converting circuit, and the like, all of which for example may be conventional components, and are not repeated herein.

The technical effects of the display device 1 may refer to the technical effects of the pixel circuit 10 according to the embodiments of the present disclosure, and are not repeated herein.

For example, the display device 1 according to the present embodiment may be any product or component with a display function, such as electronic paper, a mobile phone, a tablet PC, a TV, a display, a laptop, a digital photo frame, a navigator, or the like.

The embodiments of the present disclosure further provide a method of driving a pixel circuit 10 according to the embodiment of the present disclosure. For example, in an example, this driving method includes an initialization stage, a data writing and compensating stage and a light emitting stage.

At the initialization stage, the reset signal is input to turn on the reset circuit 400, and apply the reset voltage to the control terminal 130 of the drive circuit 100 and the first terminal 610 of the light emitting element 600.

At the data writing and compensating stage, the scan signal and the data signal are input to turn on the data writing circuit 200, the drive circuit 100 and the compensating circuit 300. The data writing circuit 200 writes the data signal to the drive circuit 100 and the compensating circuit 300 compensates the drive circuit 100.

At the light emitting stage, the first light emitting control signal is input to turn on the first light emitting control circuit 500 and the drive circuit 100, and the first light emitting control circuit 500 applies the drive current to the light emitting element 600 to make the light emitting element 600 emit light.

For example, in another example, based on the above-mentioned examples, the pixel circuit 10 further includes a second light emitting control circuit 700. The driving method further include a pre-light emitting stage.

At the initialization stage, the reset signal and the second light emitting control signal are input to turn on the reset circuit 400 and the second light emitting control circuit 700, and to apply the reset voltage to the control terminal 130 and the second terminal 120 of the drive circuit 100 and the first terminal 610 of the light emitting element 600.

At the data writing and compensating stage, the scan signal and the data signal are input to turn on the data writing circuit 200, the drive circuit 100 and the compensating circuit 300. The data writing circuit 200 writes the data signal to the drive circuit 100 and the compensating circuit 300 compensates the drive circuit 100.

At the pre-light emitting stage, the first light emitting control signal is input to turn on the first light emitting control circuit 500 and the drive circuit 100, and the first light emitting control circuit 500 applies the first voltage to the first terminal 110 of the drive circuit 100.

At the light emitting stage, the first light emitting control signal and the second light emitting control signal are input to turn on the first light emitting control circuit 500, the second light emitting control circuit 700 and the drive circuit 100. The second light emitting control circuit 700 applies the drive current to the light emitting element 600 to make the light emitting element 600 emit light.

In another example, based on the above-mentioned examples, the pixel circuit 10 further includes a light emitting control signal switch circuit 800. The driving method includes the following steps.

At the initialization stage, the reset signal, the second light emitting control signal and the light emitting control switch signal are input to turn on the reset circuit 400 and the light emitting control signal switch circuit 800, such that the second light emitting control signal is applied to the control terminal 530 of the first light emitting control circuit 500 or the control terminal 730 of the second light emitting control circuit 700, and the reset voltage is applied to the control terminal 130 of the drive circuit 100 and the first terminal 610 of the light emitting element 600.

At the data writing and compensating stage, the scan signal and the data signal are input to turn on the data writing circuit 200, the drive circuit 100 and the compensating circuit 300. The data writing circuit 200 writes the data signal to the drive circuit 100 and the compensating circuit 300 compensates the drive circuit 100.

At the pre-light emitting stage, the light emitting control switch signal and the first light emitting control signal are input to apply the first light emitting control signal to the control terminal 530 of the first light emitting control circuit 500 or the control terminal 730 of the second light emitting control circuit 700. When the first light emitting control signal is applied to the control terminal 530 of the first light emitting control circuit 500, the first light emitting control circuit 500 applies the first voltage VDD to the first terminal 510 of the drive circuit 100.

At the light emitting stage, the light emitting control switch signal, the first light emitting control signal and the second light emitting control signal are input to turn on the first light emitting control circuit 500, the second light emitting control circuit 700 and the drive circuit 100. The second light emitting control circuit 700 applies the drive current to the light emitting element 600 to make the light emitting element 600 emit light.

It should be noted that the detailed description of the driving method may refer to the description of the working principle of the pixel circuit 10 in the embodiment of the present disclosure, which will not be repeated herein.

The driving method according to the present embodiment may alleviate the problem of a short-term residual image due to the retardation effect, and compensate the threshold voltage of the drive circuit, thereby for example avoiding the non-uniform display effect. Therefore, the display effect of the display device which uses this pixel circuit is improved.

What are described above is related to the illustrative embodiments of the disclosure only and not limitative to the scope of the disclosure; the scopes of the disclosure are defined by the accompanying claims.

What is claimed is:

1. A pixel circuit, comprising a drive circuit, a data writing circuit, a compensating circuit, a reset circuit, a first light emitting control circuit, a second light emitting control circuit and a light emitting control signal switch circuit, wherein the drive circuit comprises a control terminal, a first terminal and a second terminal, and the drive circuit is configured to control a drive current for driving a light emitting element to emit light;

the data writing circuit is coupled to the first terminal of the drive circuit, and the data writing circuit is configured to write a data signal to the first terminal of the drive circuit in response to a scan signal;

the compensating circuit is coupled to the control terminal and the second terminal of the drive circuit and a first voltage terminal, and the compensating circuit is configured to compensate the drive circuit in response to the scan signal and the written data signal;

the reset circuit is coupled to the control terminal of the drive circuit and the light emitting element, and the reset circuit is configured to apply a reset voltage to the control terminal of the drive circuit and the first terminal of the light emitting element in response to a reset signal; and the first light emitting control circuit is coupled to the first terminal of the drive circuit, and the first light emitting control circuit is configured to apply a first voltage of the first voltage terminal to the first terminal of the drive circuit in response to a first light emitting control signal, wherein the light emitting control signal switch circuit is coupled to a control terminal of the first light emitting control circuit and a control terminal of the second light emitting control circuit, and the light emitting control signal switch circuit is configured to apply the first light emitting control signal and a second light emitting control signal to the control terminal of the first light emitting control circuit and the control terminal of the second light emitting control circuit in response to the light emitting control switch signal.

2. The pixel circuit according to claim 1, wherein a first terminal and a second terminal of the second light emitting control circuit are coupled to a first terminal of the light emitting element and the second terminal of the drive circuit respectively, and the first terminal and the second terminal of the second light emitting control circuit are configured to apply the drive current to the light emitting element in response to the second light emitting control signal.

3. The pixel circuit according to claim 1, wherein the drive circuit comprises a first transistor;

a gate of the first transistor is used as the control terminal of the drive circuit, a first electrode of the first transistor is used as the first terminal of the drive circuit, and a second electrode of the first transistor is used as the second terminal of the drive circuit.

4. The pixel circuit according to claim 1, wherein the data writing circuit comprises a second transistor;

a gate of the second transistor is used as a control terminal of the data writing circuit and is configured to be coupled to a scan line to receive the scan signal, a first electrode of the second transistor is used as a first terminal of the data writing circuit and is configured to be coupled to a data line to receive the data signal, and a second electrode of the second transistor is used as a second terminal of the data writing circuit and is coupled to the first terminal of the drive circuit.

5. The pixel circuit according to claim 1, wherein the compensating circuit comprises a third transistor and a capacitor;

a gate of the third transistor is coupled to a scan line to receive the scan signal, a first electrode of the third transistor is coupled to the control terminal of the drive circuit, a second electrode of the third transistor is coupled to the second terminal of the drive circuit; and a first electrode of the capacitor is coupled to the control terminal of the drive circuit, a second electrode of the capacitor is coupled to the first voltage terminal to receive a first voltage.

6. The pixel circuit according to claim 1, wherein the reset circuit comprises a fourth transistor and a fifth transistor;

a gate of the fourth transistor is coupled to a reset control line to receive the reset signal, a first electrode of the fourth transistor is coupled to the control terminal of the drive circuit, and a second electrode of the fourth transistor is coupled to a reset voltage terminal to receive the reset voltage; and a gate of the fifth transistor is coupled to the reset control line to receive the reset signal, a first electrode of the fifth transistor is coupled to the first terminal of the light emitting element, and a second electrode of the fifth transistor is coupled to the reset voltage terminal to receive the reset voltage.

7. The pixel circuit according to claim 1, wherein the first light emitting control circuit comprises a sixth transistor;

a gate of the sixth transistor is used as a control terminal of the first light emitting control circuit and is configured to be coupled to a first light emitting control line to receive the first light emitting control signal, a first electrode of the sixth transistor is used as a first terminal of the first light emitting control circuit, and is configured to be coupled to the first voltage terminal to receive the first voltage, and a second electrode of the sixth transistor is used as a second terminal of the first light emitting control circuit and is coupled to the first terminal of the drive circuit.

8. The pixel circuit according to claim 2, wherein the second light emitting control circuit comprises a seventh transistor;

a gate of the seventh transistor is used as a control terminal of the second light emitting control circuit, and is coupled to a second light emitting control line to receive the second light emitting control signal, a first electrode of the seventh transistor is used as the second terminal of the second light emitting control circuit and is coupled to the second terminal of the drive circuit, and a second electrode of the seventh transistor is used as the first terminal of the second light emitting control circuit and is coupled to the first terminal of the light emitting element.

9. The pixel circuit according to claim 2, wherein the first light emitting control signal and the second light emitting control signal are both turn-on signals in part of a period.

10. The pixel circuit according to claim 1, wherein the light emitting control signal switch circuit comprises an eighth transistor, a ninth transistor, a tenth transistor and an eleventh transistor;

a gate of the eighth transistor is configured to receive the light emitting control switch signal, a first electrode of the eighth transistor is coupled to a first light emitting control line to receive the first light emitting control signal, a second electrode of the eighth transistor is coupled to the control terminal of the first light emitting control circuit;

a gate of the ninth transistor is configured to receive the light emitting control switch signal, a first electrode of the ninth transistor is coupled to a second light emitting control line to receive the second light emitting control signal, a second electrode of the ninth transistor is coupled to the control terminal of the second light emitting control circuit;

a gate of the tenth transistor is configured to receive the light emitting control switch signal, a first electrode of the tenth transistor is coupled to the second light emitting control line, a second electrode of the tenth transistor is coupled to the control terminal of the first light emitting control circuit; and a gate of the eleventh transistor is configured to receive the light emitting control switch signal, a first electrode of the eleventh transistor is coupled to the first light emitting control line, a second electrode of the eleventh transistor is coupled to the control terminal of the second light emitting control circuit.

11. A display panel, comprising a plurality of pixel units arranged in an array, wherein each of the plurality of pixel units comprises the pixel circuit according to claim 1 and a light emitting element.

12. The display panel according to claim 11, wherein the display panel further comprises a plurality of light emitting control switch signal lines, wherein the plurality of pixel units is arranged in a plurality of rows, control terminals of the light emitting control signal switch circuits of the pixel circuits of a m-th row of pixel units are coupled to a same light emitting control switch signal line, or the control terminals of the light emitting control signal switch circuits of the pixel circuits of the m-th row of pixel units are coupled to two light emitting control switch signal lines, wherein a rising edge of a light emitting control switch signal provided by one of the two light emitting control switch signal lines corresponds to a falling edge of a light emitting control switch signal provided by a remaining one of the two light emitting control switch signal lines, wherein m is an integer greater than or equal to 1.

13. The display panel according to claim 11, wherein a first terminal of the light emitting element is configured to receive the drive current from the second terminal of the drive circuit, and a second terminal of the light emitting element is configured to be coupled to a second voltage terminal.

14. A method of driving the pixel circuit according to claim 2, comprising:

at an initialization stage, inputting the reset signal and the second light emitting control signal to turn on the reset circuit and the second light emitting control circuit to apply the reset voltage to the control terminal and the second terminal of the drive circuit and the first terminal of the light emitting element;

at a data writing and compensating stage, inputting the scan signal and the data signal to turn on the data writing circuit, the drive circuit and the compensating circuit so that the data writing circuit writes the data signal to the drive circuit, and the compensating circuit compensates the drive circuit;

at a pre-light emitting stage, inputting the first light emitting control signal to turn on the first light emitting control circuit and the drive circuit so that the first light emitting control circuit applies the first voltage to the first terminal of the drive circuit; and at a light emitting stage, inputting the first light emitting control signal and the second light emitting control signal to turn on the first light emitting control circuit, the second light emitting control circuit and the drive circuit so that the second light emitting control circuit applies the drive current to the light emitting element to make the light emitting element emit light.

15. A method of driving the pixel circuit according to claim 1, comprising:

at an initialization stage, inputting the reset signal, the second light emitting control signal and the light emitting control switch signal to turn on the reset circuit and the light emitting control signal switch circuit to apply the second light emitting control signal to the control terminal of the first light emitting control circuit or the control terminal of the second light emitting control circuit and apply the reset voltage to the control terminal of the drive circuit and the first terminal of the light emitting element;

at a data writing and compensating stage, inputting the scan signal and the data signal to turn on the data writing circuit, the drive circuit and the compensating circuit so that the data writing circuit writes the data signal to the drive circuit, and the compensating circuit compensates the drive circuit;

at a pre-light emitting stage, inputting the light emitting control switch signal and the first light emitting control signal to apply the first light emitting control signal to the control terminal of the first light emitting control circuit or the control terminal of the second light emitting control circuit, wherein in a case where the first light emitting control signal is applied to the control terminal of the first light emitting control circuit, the first light emitting control circuit applies the first voltage to the first terminal of the drive circuit; and at a light emitting stage, inputting the light emitting control switch signal, the first light emitting control signal and the second light emitting control signal to turn on the first light emitting control circuit, the second light emitting control circuit and the drive circuit so that the second light emitting control circuit applies the drive current to the light emitting element to make the light emitting element emit light.

16. The pixel circuit according to claim 2, wherein the drive circuit comprises a first transistor;

a gate of the first transistor is used as the control terminal of the drive circuit, a first electrode of the first transistor is used as the first terminal of the drive circuit, and a second electrode of the first transistor is used as the second terminal of the drive circuit.

17. The pixel circuit according to claim 1, wherein the drive circuit comprises a first transistor;

a gate of the first transistor is used as the control terminal of the drive circuit, a first electrode of the first transistor is used as the first terminal of the drive circuit, and a second electrode of the first transistor is used as the second terminal of the drive circuit.

18. The pixel circuit according to claim 2, wherein the data writing circuit comprises a second transistor;

a gate of the second transistor is used as a control terminal of the data writing circuit and is configured to be coupled to a scan line to receive the scan signal, a first electrode of the second transistor is used as a first terminal of the data writing circuit and is configured to be coupled to a data line to receive the data signal, and a second electrode of the second transistor is used as a second terminal of the data writing circuit and is coupled to the first terminal of the drive circuit.

19. A pixel circuit, comprising a drive circuit, a data writing circuit, a compensating circuit, a reset circuit, a first light emitting control circuit, a second light emitting control circuit and a light emitting element, wherein the drive circuit comprises a first transistor, a gate of the first transistor is coupled to a first node, a first electrode of the first transistor is coupled to a second node, and a second electrode of the first transistor is coupled to a third node;

the data writing circuit comprises a second transistor, a gate of the second transistor is coupled to a scan line to receive a scan signal, a first electrode of the second transistor is coupled to a data line to receive a data signal, and a second electrode of the second transistor is coupled to the second node;

the compensating circuit comprises a third transistor and a capacitor, a gate of the third transistor is coupled to the scan line to receive the scan signal, a first electrode of the third transistor is coupled to the first node, a second electrode of the third transistor is coupled to the third node; and a first electrode of the capacitor is coupled to the first node, a second electrode of the capacitor is coupled to a first voltage terminal to receive a first voltage;

the reset circuit comprises a fourth transistor and a fifth transistor, a gate of the fourth transistor is coupled to a reset control line to receive a reset signal, a first electrode of the fourth transistor is coupled to the first node, and a second electrode of the fourth transistor is coupled to a reset voltage terminal to receive a reset voltage; and a gate of the fifth transistor is coupled to the reset control line to receive the reset signal, a first electrode of the fifth transistor is coupled to a fourth node, and a second electrode of the fifth transistor is coupled to the reset voltage terminal to receive the reset voltage;

the first light emitting control circuit comprises a sixth transistor, a gate of the sixth transistor is coupled to a first light emitting control line to receive a first light emitting control signal, a first electrode of the sixth transistor is coupled to the first voltage terminal to receive the first voltage, and a second electrode of the sixth transistor is coupled to the second node;

the second light emitting control circuit comprises a seventh transistor, a gate of the seventh transistor is coupled to a second light emitting control line to receive a second light emitting control signal, a first electrode of the seventh transistor is coupled to the third node, and a second electrode of the seventh transistor is coupled to the fourth node; and a first terminal of the light emitting element is coupled to the fourth node to receive a drive current from the third node, a second terminal of the light emitting element is coupled to a second voltage terminal to receive a second voltage, wherein at an initialization stage, the reset circuit is configured to receive the reset signal to apply the reset voltage to the first node and the fourth node, and the second light emitting control circuit is configured to receive the second light emitting control signal to apply the reset voltage to the third node;

at a data writing and compensating stage, the data writing circuit is configured to receive the scan signal to apply the data signal to the second node, and the compensating circuit is configured to receive the scan signal to compensate the drive circuit;

at a pre-light emitting stage, the first light emitting control circuit is configured to receive the first light emitting control signal to apply the first voltage to the second node; and at a light emitting stage, the first light emitting control circuit is configured to receive the first light emitting control signal and the second light emitting control circuit is configured to receive the second light emitting control signal, such that the second light emitting control circuit applies the drive current to the light emitting element to emit light.

* * * * *